US010130893B2

(12) United States Patent
Heston

(10) Patent No.: US 10,130,893 B2
(45) Date of Patent: Nov. 20, 2018

(54) INTERLOCKING TOY STRUCTURE AND METHODS OF MANUFACTURING THE SAME

(71) Applicant: Christian G. Heston, Columbia, MO (US)

(72) Inventor: Christian G. Heston, Columbia, MO (US)

( * ) Notice: Subject to any disclaimer, the term of this patent is extended or adjusted under 35 U.S.C. 154(b) by 0 days.

(21) Appl. No.: 14/688,248

(22) Filed: Apr. 16, 2015

(65) Prior Publication Data

US 2016/0136535 A1 May 19, 2016

Related U.S. Application Data

(60) Provisional application No. 62/123,487, filed on Nov. 18, 2014.

(51) Int. Cl.

| | |
|---|---|
| ***A63H 33/08*** | (2006.01) |
| ***A63H 33/04*** | (2006.01) |
| ***A63H 3/52*** | (2006.01) |

(52) U.S. Cl.

CPC ..... *A63H 33/044* (2013.01); *A63H 3/52* (2013.01); *A63H 33/084* (2013.01)

(58) Field of Classification Search

CPC ..... A63H 33/04; A63H 33/044; A63H 33/08; A63H 33/082; A63H 33/084; A63H 33/086; A63H 33/088

USPC ..... 446/108, 111, 112, 113, 114, 115, 116

See application file for complete search history.

(56) References Cited

U.S. PATENT DOCUMENTS

| | | | | | |
|---|---|---|---|---|---|
| 1,533,011 | A | * | 4/1925 | Knaggs | A63H 33/16 446/112 |
| 1,569,066 | A | * | 1/1926 | Beiger | A63H 33/044 446/108 |
| 1,867,374 | A | | 7/1932 | Myers | |
| 2,075,259 | A | * | 3/1937 | Battjes | A63H 33/06 229/198.2 |
| 2,204,264 | A | | 6/1940 | Warren | |
| 2,334,912 | A | * | 11/1943 | Eide | A47B 47/042 108/158.12 |
| 2,558,591 | A | * | 6/1951 | Starck | A63H 33/084 217/17 |
| 2,712,200 | A | | 7/1955 | Dearling | |
| 2,844,910 | A | | 7/1958 | Korchak | |
| 2,915,040 | A | * | 12/1959 | Ward | A01K 31/14 119/431 |

(Continued)

FOREIGN PATENT DOCUMENTS

WO 2008070376 A2 6/2008

*Primary Examiner* — Melba Bumgarner
*Assistant Examiner* — Joseph B Baldori
(74) *Attorney, Agent, or Firm* — Erickson Kernell IP, LLC; John C. McMahon

(57) ABSTRACT

An interlocking structure is provided. The interlocking structure includes a floor panel which has a floor tab, a floor groove, and a floor tenon. A side panel includes a first side tab, a second side tab, and a side groove, wherein the side groove is removably coupled to the floor groove. A top panel has a top tab, a top groove, and a top tenon, wherein the top tab is removably coupled to the side groove and the top groove is removably coupled to the first side tab. A back panel has a back tab, a back groove, a first back mortise and a second back mortise. The first back mortise is configured to receive the floor tenon and the second back mortise is configured to receive the top tenon. A rod is removably coupled to at least one of the floor tenon and the top tenon.

12 Claims, 21 Drawing Sheets

(56) References Cited

U.S. PATENT DOCUMENTS 3,007,279 A 11/1961 Korchak
3,066,436 A * 12/1962 Schuh ..... A63H 33/06 428/542.2
3,137,967 A 6/1964 Flieth
3,143,236 A 8/1964 Haas
3,195,507 A * 7/1965 Miller ..... A01K 31/14 119/431
3,234,680 A * 2/1966 Irving ..... A63H 3/52 446/109
3,337,983 A * 8/1967 Ebstein ..... A63H 33/04 108/180
3,547,491 A * 12/1970 Bovasso ..... A47C 4/021 297/440.13
3,698,124 A * 10/1972 Reitzel ..... A63H 33/06 428/542.2
3,751,848 A * 8/1973 Ahlstrand ..... A63H 33/044 434/79
3,788,700 A * 1/1974 Wartes ..... A47B 3/00 108/101
3,820,294 A * 6/1974 Parker ..... E04B 1/34315 446/115
3,855,748 A * 12/1974 Thomas ..... A63B 9/00 446/115
3,906,659 A 9/1975 Walmer
4,018,001 A 4/1977 Walmer
4,021,960 A 5/1977 Walmer
4,055,924 A 11/1977 Beaver, Jr.
4,082,356 A * 4/1978 Johnson ..... A47C 4/03 273/160
4,107,869 A 8/1978 Abrams
4,140,065 A * 2/1979 Chacon ..... A47C 4/021 108/156
4,170,083 A 10/1979 Freelander et al.
4,182,244 A * 1/1980 Hutchins, Jr. ..... A47F 5/116 108/53.1
4,188,067 A * 2/1980 Elmer ..... A47C 4/03 297/440.13
4,309,851 A 1/1982 Flagg
4,513,064 A * 4/1985 Marcus ..... H05K 3/366 361/803
4,523,418 A * 6/1985 McLaughlin ..... A63H 33/06 403/285
4,562,776 A * 1/1986 Miranda ..... A47B 47/042 108/158.12
4,569,664 A * 2/1986 Giampetruzzi ..... A63H 33/008 446/110
4,646,927 A * 3/1987 Williams ..... B65D 9/12 217/12 R
4,740,188 A 4/1988 Coster
4,759,520 A 7/1988 Levine
4,809,146 A 2/1989 Johnson
4,946,414 A * 8/1990 Zimmer ..... A63H 33/38 281/15.1
4,978,301 A * 12/1990 Dodge ..... A63H 33/042 434/96
4,991,726 A 2/1991 Johnson
5,009,599 A * 4/1991 Mueller ..... G09B 11/00 434/81
5,082,329 A * 1/1992 Mars ..... A47C 4/02 108/180
5,145,110 A 9/1992 Terpstra
5,186,123 A * 2/1993 Cuddy ..... A01K 31/14 119/434
5,281,181 A * 1/1994 McCollum ..... A63H 33/044 446/106
5,281,185 A 1/1994 Lee
5,310,376 A 5/1994 Mayuzumi et al.
5,320,065 A 6/1994 Leopold
5,351,453 A * 10/1994 Leslie ..... E04H 1/1205 446/110
5,580,294 A * 12/1996 Briant ..... A63H 33/044 446/110
5,762,530 A * 6/1998 Zheng ..... A63F 9/12 273/160
5,853,313 A * 12/1998 Zheng ..... A63H 33/065 403/345
5,910,038 A * 6/1999 Zheng ..... A63F 9/12 446/114
5,921,631 A * 7/1999 Bush ..... A47C 3/029 297/440.1
5,992,938 A * 11/1999 Jones ..... A47C 4/03 297/440.13
6,116,981 A * 9/2000 Zheng ..... A63H 33/065 446/106
6,126,022 A * 10/2000 Merkel ..... A47B 47/042 108/180
6,397,781 B1 * 6/2002 Bellington ..... A01K 31/14 119/431
6,439,945 B1 * 8/2002 Liu ..... A63H 3/16 273/156
6,520,831 B1 2/2003 Craig
6,595,378 B2 * 7/2003 Wang ..... A47B 47/0075 211/186
6,619,749 B2 * 9/2003 Willy ..... A47B 3/06 108/158.12
6,684,591 B2 * 2/2004 Jean ..... A63H 33/06 206/176
6,711,860 B2 3/2004 Fleishman
6,739,937 B2 5/2004 Snelson
6,923,705 B2 8/2005 DeSalvo et al.
7,168,766 B2 * 1/2007 Pelletier ..... A47C 3/029 297/440.13
7,241,198 B1 7/2007 Boone
7,407,425 B2 * 8/2008 Jeske ..... A63H 3/52 446/108
7,601,069 B2 * 10/2009 Freres ..... A63H 33/32 446/106
8,105,127 B2 * 1/2012 Heston ..... A63H 33/044 446/106
8,458,980 B2 * 6/2013 Ivanov ..... A63H 33/084 446/105
8,590,976 B2 * 11/2013 Davis ..... A47B 47/0075 297/440.1
8,621,739 B1 * 1/2014 Elliot ..... A63H 33/084 29/428
8,650,807 B2 * 2/2014 McKimmy ..... E04B 1/34321 403/315
8,651,297 B2 * 2/2014 Beaty ..... A47F 5/116 211/135
8,696,399 B2 * 4/2014 Mimlitch ..... A63H 33/108 403/384
8,832,917 B1 * 9/2014 Elliott ..... B23P 17/00 29/428
8,845,381 B2 * 9/2014 Ziegler ..... A63H 33/08 446/108
9,022,389 B1 * 5/2015 Berg ..... A63H 33/105 273/148 A
9,340,967 B2 * 5/2016 Daenen ..... A63H 33/084
2006/0284372 A1 * 12/2006 Matilla ..... A63H 33/084 273/236
2009/0302046 A1 12/2009 Roberts, Sr. et al.
2010/0093257 A1 * 4/2010 Elliott ..... A47B 3/06 446/478
2011/0036040 A1 * 2/2011 Child ..... A63F 9/088 52/588.1
2012/0015582 A1 1/2012 van Tilburg
2012/0152178 A1 6/2012 McLean et al.
2014/0235133 A1 8/2014 Ksobiech et al.
2014/0274432 A1 * 9/2014 Tsai ..... A01K 1/035 472/136
2014/0373357 A1 * 12/2014 Elliott ..... B23P 11/00 29/897
2015/0099417 A1 * 4/2015 Draghicescu ..... A63H 33/08 446/108
2016/0074767 A1 * 3/2016 Kislevitz ..... A63H 33/08 446/124

* cited by examiner

INTERLOCKING TOY STRUCTURE AND METHODS OF MANUFACTURING THE SAME

CROSS-REFERENCE TO RELATED APPLICATION

This nonprovisional application claims priority to U.S. Provisional Patent Application Ser. No. 62/123,487, filed on Nov. 18, 2014, which is hereby incorporated by reference in its entirety.

BACKGROUND

Toy structures such as dollhouses, cabins, bookshelves, and castles may use wood components for assembly purposes. Typical wood components may include grooved panels, notched logs, and tabbed planks which are interconnected to build the toy structure. Some wood components, however, may be poorly formed and result in poor appearance. Moreover, some toy structures, due to manufacturing tolerances, may not properly assemble resulting in further fastening, screwing, and/or gluing to stabilize the structure. Other conventional toy structures may use complicated interconnections or may require tools for assembly/disassembly which may lead to poor construction or frustration for the user. Still further, some typical toy structures may require custom machining for different components which may result in higher cost and waste by-products.

Convenient assembly and disassembly of toy structures without the use of tools is advantageous for the user. Moreover, convenient intersection of wood components is advantageous for assembly and disassembly of the toy structure and for the rigidity of the toy structure.

SUMMARY

In one aspect, an interlocking structure is provided. The interlocking structure includes a floor panel which has a floor tab, a floor groove, and a floor tenon. A side panel is removably coupled to the floor panel and includes a first side tab, a second side tab, and a side groove. The side groove is removably coupled to the floor groove. A top panel is removably coupled to the side panel and has a top tab, a top groove, and a top tenon, wherein the top tab is removably coupled to the side groove and the top groove is removably coupled to the first side tab. A back panel is removably coupled to the side panel and the top panel and has a back tab, a back groove, a first back mortise and a second back mortise. The first back mortise is configured to receive the floor tenon and the second back mortise is configured to receive the top tenon. A rod is removably coupled to at least one of the floor tenon and the top tenon.

In a further aspect, an interlocking toy structure is provided. The interlocking structure includes a back panel having a wall. The wall includes a first floor mortise and a second floor mortise; and, a first intermediate mortise and a second intermediate mortise. A floor panel is removably coupled to the back panel and comprising a first floor tenon and a second floor tenon. A first intermediate floor panel is removably coupled to the back panel and includes a first intermediate floor tenon and a second intermediate floor tenon. A top panel is removably coupled to the back panel and having a first top tenon and a second top tenon. A first rod removably is coupled to at least one of the first floor tenon, the first intermediate floor tenon, and the first top tenon.

In another aspect, a method of manufacturing an interlocking structure is provided. The method includes forming a floor panel comprising a floor tab, a floor groove, and a floor tenon. A side panel is formed which includes a first side tab, a second side tab, and a side groove, wherein the first side tab is configured to removably couple to the floor groove. The method includes forming a top panel having a top tab, a top groove, and a top tenon, wherein the top tab is configured to removably couple to the first side groove and the top groove is removably coupled to the first side tab. Moreover, the method includes forming a back panel having a back tab, a back groove, a first back mortise and a second back mortise, wherein the first back mortise is configured to receive the floor tenon and the second back mortise is configured to receive the top tenon. A rod is formed wherein the rod is removably coupled to at least one of the floor tenon and the top tenon.

Still further, in another aspect, an interlocking structure is provided. The interlocking structure includes a side panel comprising a side tab, and a side groove. A top panel is removably coupled to the side panel and includes a top tab, a top groove, and a top tenon, wherein the top tab is removably coupled to the side groove and the top groove is removably coupled to the side tab. The interlocking structure includes a back panel removably coupled to the side panel and the top panel and includes a back tab, a back groove, and a back mortise, the back mortise is configured to receive the top tenon. A rod is removably coupled to the top tenon

BRIEF DESCRIPTION OF THE DRAWINGS

Features, aspects, and advantages of the present disclosure will become better understood when the following Detailed Description is read with reference to the accompanying drawings in which like characters represent like parts throughout, wherein.

DETAILED DESCRIPTION OF THE DRAWINGS

Aspects of the present disclosure relate to interlocking structures designed to easily assemble and remain effectively assembled without the use of assembly tools. The types of components used in the interlocking structure provide a user with various means for convenient and efficient assembly, use, disassembly, and storage of the interlocking structure. The interlocking structure is made from a plurality of panels that are designed to fit together using a plurality of different construction joints to facilitate creating the harmonious interlocking structure. The panels allow the user to easily and effectively assemble and disassemble for storage. Once assembled, the structure is free standing and sturdy. When disassembled, the panels stack flat to facilitate minimal storage space. The interlocking structure can comprise any suitable material including, but not limited to, plywood, solid wood, particle wood, plastic, and metal. The interlocking structure can be used as a play item such as a dollhouse or used as a storage item such as a bookshelf. The interlocking structure may include any suitable shape, purpose, and can be scaled to any size.

Figure 1:
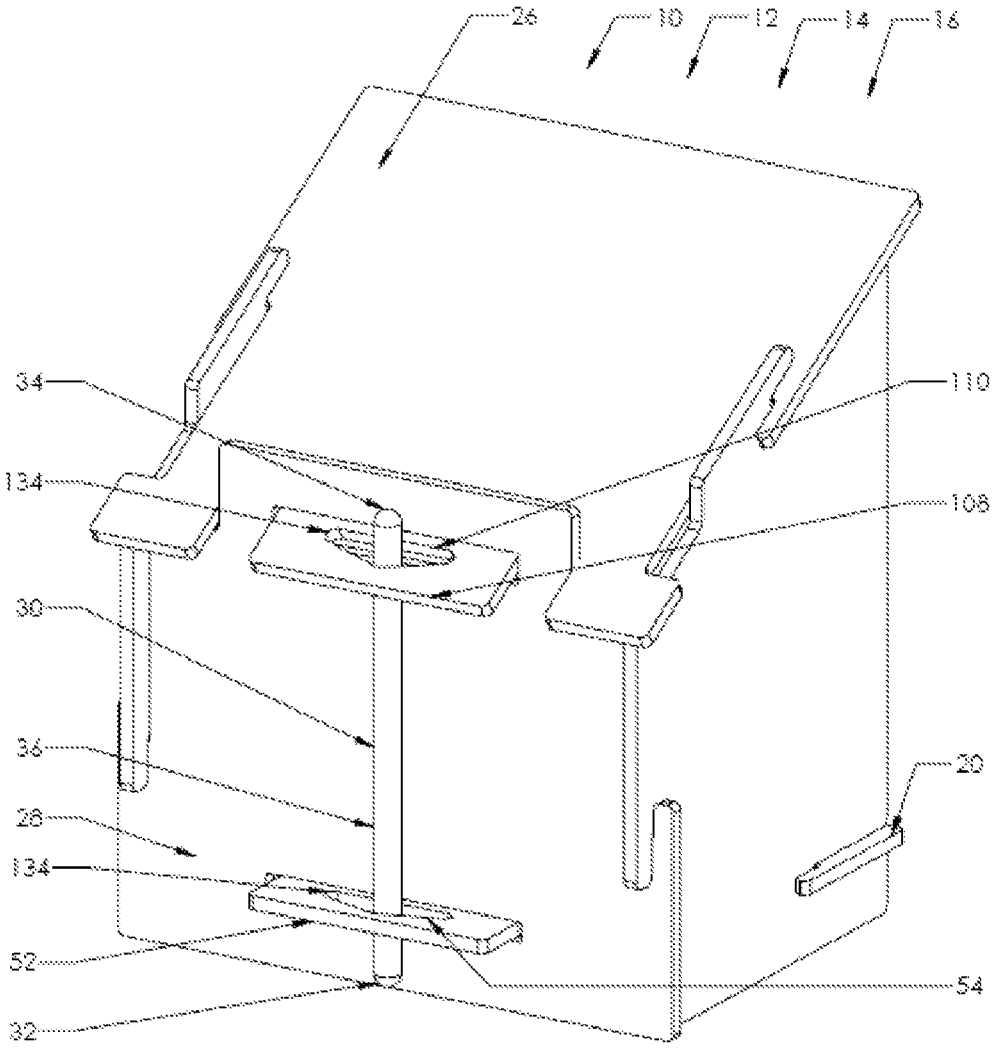
FIG. 1 is a rear perspective view of an exemplary interlocking structure of the present disclosure illustrated in an assembled position.
Figure 1A:
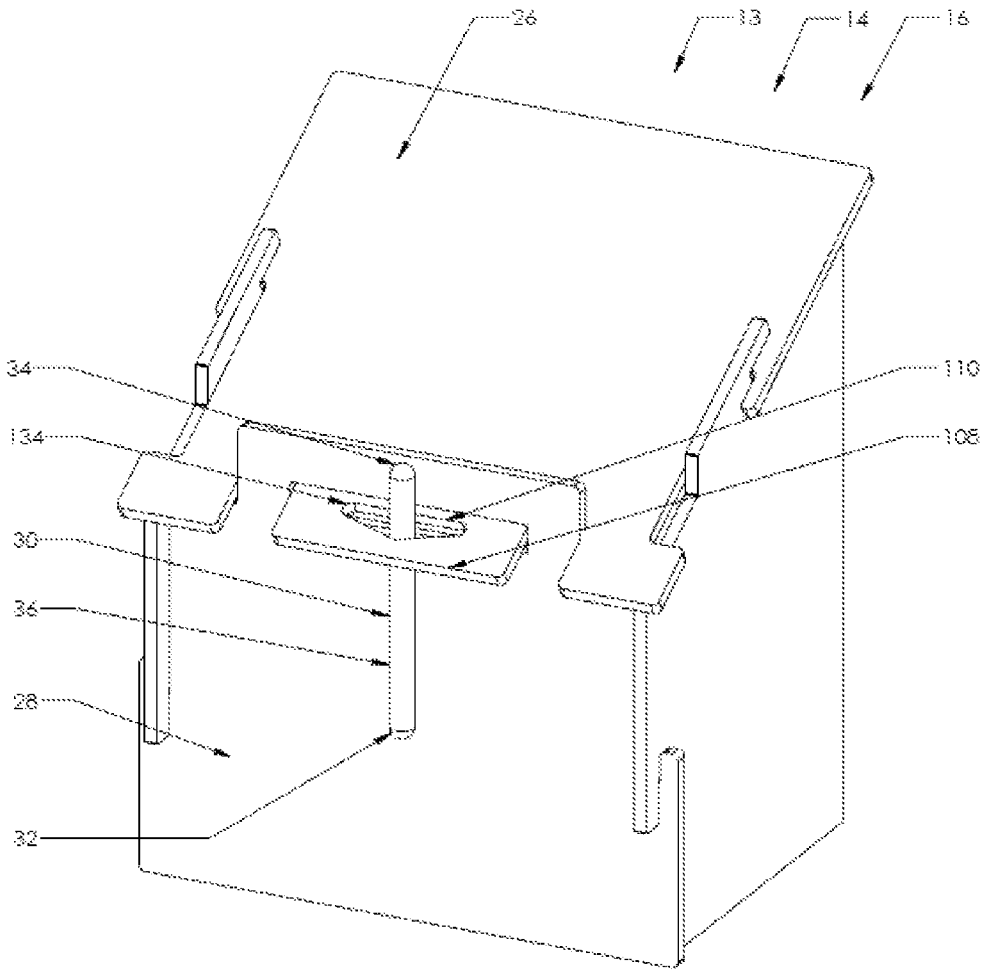
FIG. 1*a* is a rear perspective view of another exemplary interlocking structure of the present disclosure in an assembled position.
Figure 2:
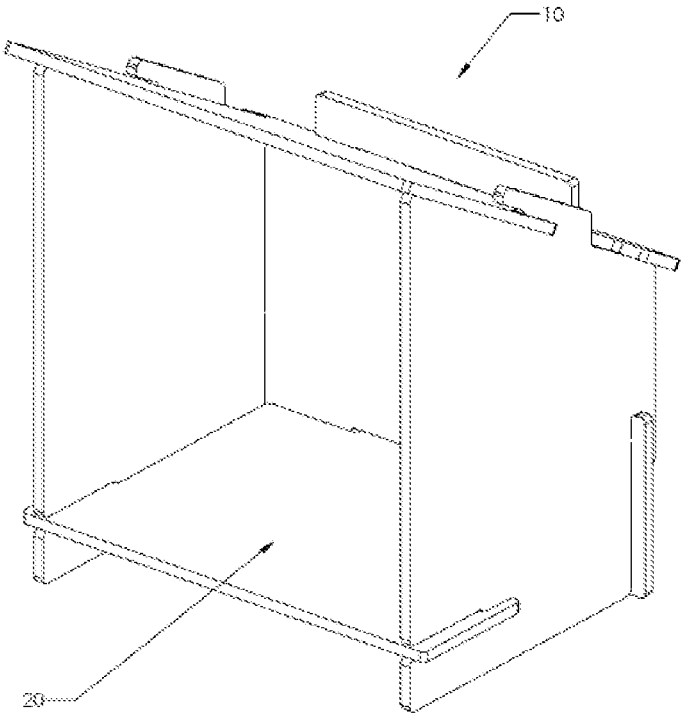
FIG. 2 is a front perspective view of the interlocking structure of FIG. 1.
Figure 2A:
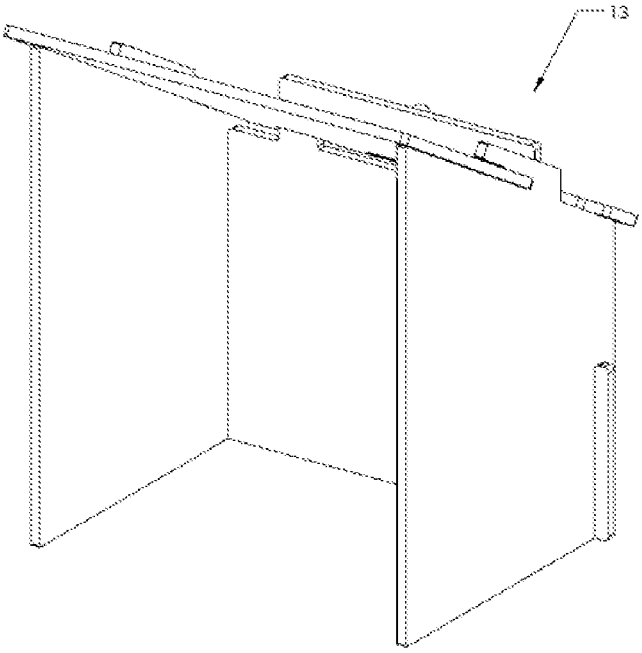
FIG. 2*a* is a front perspective view of the interlocking structure shown in FIG. 1*a;*
Figure 3:
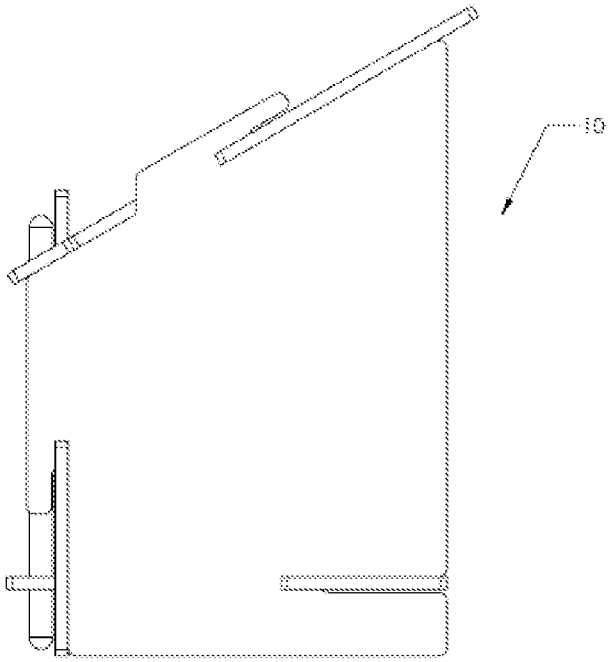
FIG. 3 is a side view of the interlocking structure of FIG. 1.
Figure 3A:
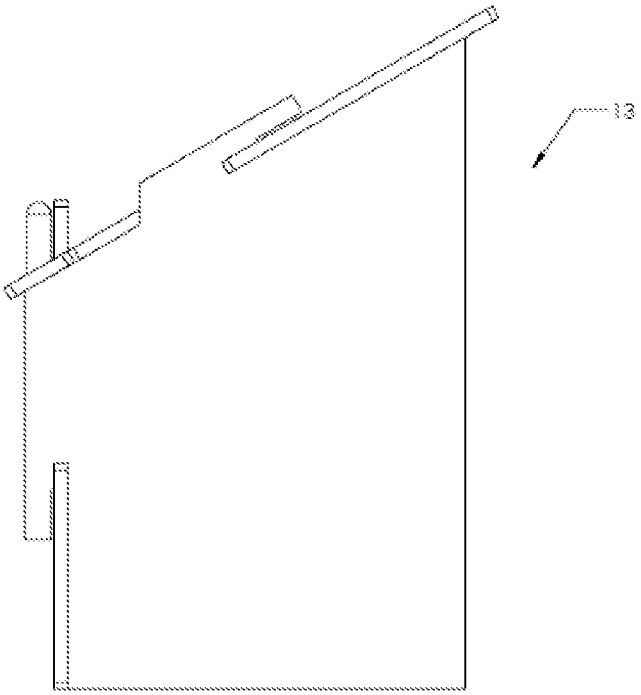
FIG. 3*a* is a side view of the interlocking structure shown in FIG. 1*a;*

FIG. 1 is a rear perspective view of an interlocking structure 10 such as, for example, a toy interlocking structure. The interlocking structure 10 is shown in an assembled position 12. FIG. 2 is a front perspective view of the interlocking structure 10. FIG. 3 is a side view of the interlocking structure 10. In the exemplary embodiment, the interlocking structure 10 includes a shape 14 of a house. Alternatively, the interlocking structure 10 can include any type of shape. The interlocking structure 10 includes a plurality of panels 16 and a compression fastener 18 which is configured to removably couple together at least two panels of the plurality of panels 16. Moreover, the plurality of panels 16 are configured to removably couple to each other without the need of an assembly tool such as, but not limited to, a screwdriver, a hammer, and glue. FIGS. 1*a*, 2*a*, and 3*a* illustrate views of an alternative interlocking structure 13 wherein the plurality of panels 16 excludes a panel such as, for example only, a floor panel.

Figure 4A:
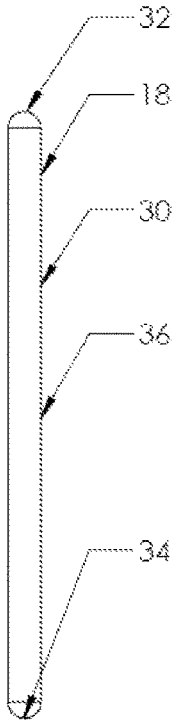
FIG. 4*a* is a side view of a rod of a compression fastener of the interlocking structure of FIG. 1.

FIG. 4*a* is a side view of a rod 30 of the compression fastener 18, and FIGS. 4*b*-4*f* are views of panels of the plurality of panels 16. In FIGS. 4*a*-4*f*, similar components have the same element numbers as components shown in FIGS. 1-3. In the exemplary embodiment, the plurality of panels 16 includes a floor panel 20, a first side panel 22, a second side panel 24, a top panel 26, and a back panel 28. The plurality of panels 16 is configured to removably couple among each other to form the interlocking structure 10. In the exemplary embodiment, the rod 30 includes a first end 32, a second end 34, and a body 36 located between the first end 32 and the second end 34. The rod 30 is selectively coupled to at least one of the floor panel 20, the top panel 26, and the back panel 28 to maintain assembly of the interlocking structure 10. Alternatively, the rod 30 may selectively couple to the first side panel 22 and/or the second side panel 24.

Figure 4B:
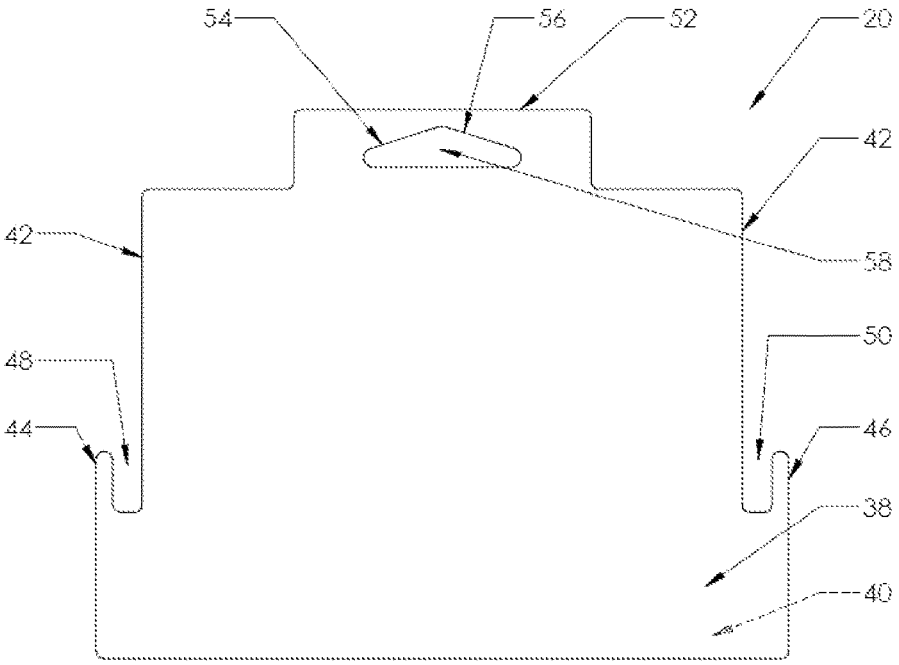
FIG. 4*b* is a plan view of a floor panel of the interlocking structure of FIG. 1.

FIG. 4*b* is a plan view of the floor panel 20 of the interlocking structure of FIG. 1. The floor panel 20 includes a top 38, a bottom 40, and side edges 42 connecting the top 38 and the bottom 40. Additionally, the floor panel 20 includes a first floor tab 44 and a second floor tab 46 which are spaced from the side edges 42. More particularly, a first floor groove 48 is located between the side edge 42 and the first floor tab 44; and, a second floor groove 50 is located between the side edge 42 and the second floor tab 46. As illustrated, the floor panel 20 includes a floor tenon 52 extending out from the side edge 42. The floor tenon 52 includes a floor aperture 54 defined by edges 56. In the exemplary embodiment, the floor aperture 54 includes a triangle shape 58. The triangle shape 58 facilitates convenient, efficient, and effective receipt of the rod 30 as described herein. Moreover, the triangle shape 58 facilitates maintaining the rod 30 coupled to at least one of the floor panel 20, the top panel 26, and the back panel 28 as described herein. The triangle shape 58 is cut to accommodate the dimensions of the rod 30 which removably fits to the internal dimensions thereof.

Figure 4C:
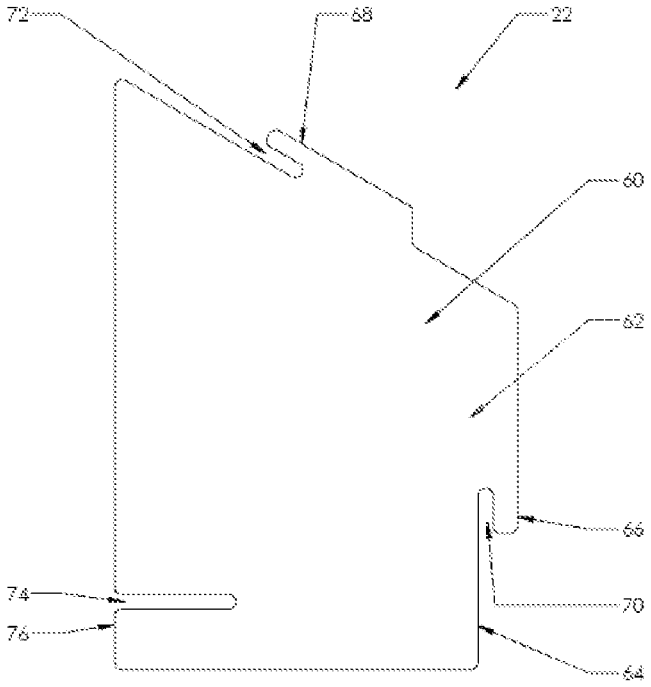
FIG. 4*c* is a side view of a first side panel of the interlocking structure of FIG. 1.

FIG. 4*c* is a side view of the first side panel 22 of the interlocking structure of FIG. 1. The first side panel 22 includes a front 60, a rear 62, and side edges 64 connecting the front 60 and the rear 62. Additionally, the first side panel 22 includes a first side tab 66 and a second side tab 68 which are spaced from the side edges 64. More particularly, a first side groove 70 is located between the side edge 64 and the first side tab 66; and, a second side groove 72 is located between the edge 64 and the second side tab 68. Still further, a third side groove 74 begins at an edge 76 and extends into the first side panel 22.

Figure 4D:
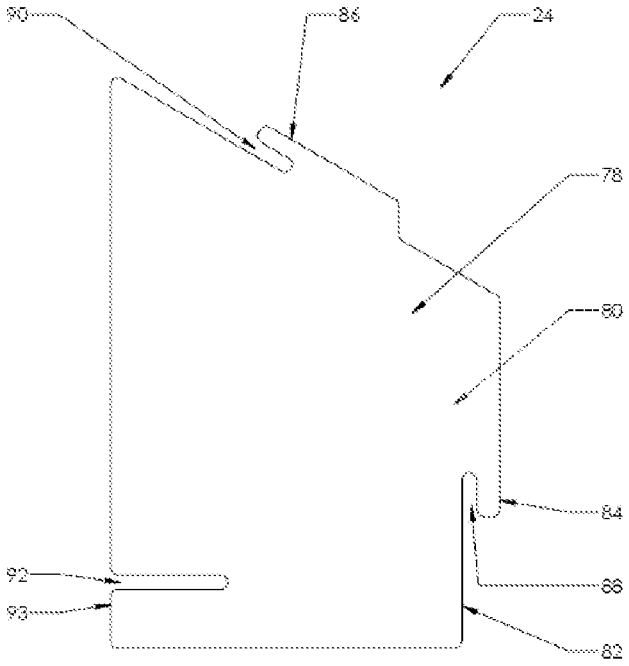
FIG. 4*d* is a side view of a second side panel of the interlocking structure of FIG. 1.

FIG. 4*d* is a side view of the second side panel 24 of the interlocking structure of FIG. 1. The second side panel 24 includes a front 78, a rear 80, and side edges 82 connecting the front 78 and the rear 80. Additionally, the second side panel 24 includes a first side tab 84 and a second side tab 86 which are spaced from the side edges 82. More particularly, a first side groove 88 is located between the side edge 82 and the first side tab 84; and, a second side groove 90 is located between the side edge 82 and the second side tab 86. Still further, a third side groove 92 begins at an edge 93 and extends into the second side panel 24.

Figure 4E:
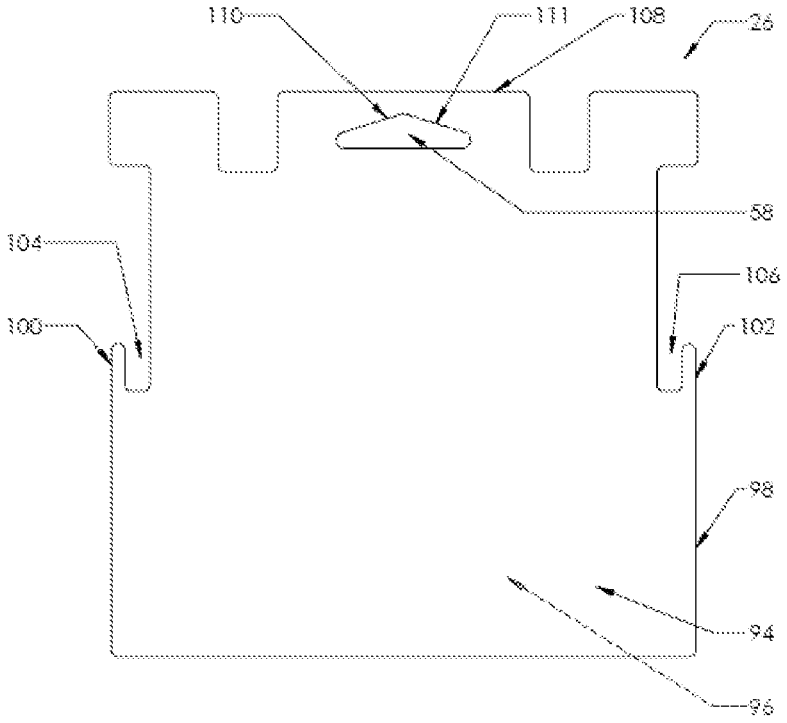
FIG. 4*e* is a plan view of a top panel of the interlocking structure of FIG. 1.

FIG. 4*e* is a plan view of the top panel 26 of the interlocking structure of FIG. 1. The top panel 26 includes a top 94, a bottom 96, and side edges 98 connecting the top 94 and the bottom 96. Additionally, the top panel 26 includes a first top tab 100 and a second top tab 102 which are spaced from the side edges 98. More particularly, a first top groove 104 is located between the side edge 98 and the first top tab 100; and, a second top groove 106 is located between the side edge 98 and the second top tab 102. As illustrated, the top panel 26 includes a top tenon 108 extending out from the edge 98. The top tenon 108 includes a top aperture 110 defined by edges 111. In the exemplary embodiment, the top aperture 110 includes the triangle shape 58. Alternatively, the top aperture 110 can include other non-triangular shapes.

Figure 4F:
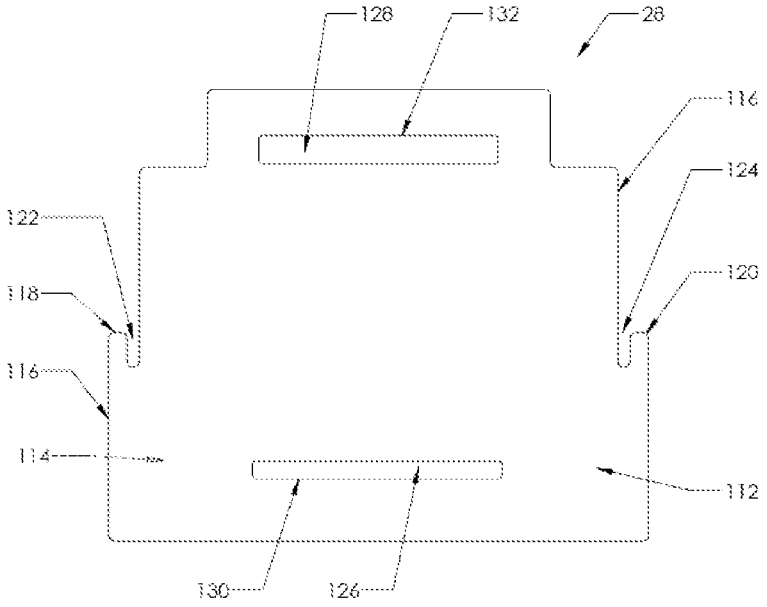
FIG. 4*f* is a plan view of a back panel of the interlocking structure of FIG. 1.

FIG. 4*f* is a plan view of the back panel 28 of the interlocking structure of FIG. 1. The back panel 28 includes a front 112, a rear 114, and side edges 116 connecting the front 112 and the rear 114. Additionally, the back panel 28 includes a first back tab 118 and a second back tab 120 which are spaced from the side edges 116. More particularly, a first back groove 122 is located between the side edge 116 and the first back tab 118; and, a second back groove 124 is located between the side edge 116 and the second back tab 120. As illustrated, the back panel 28 includes a first back mortise 126 and a second back mortise 128 defined there through. In the exemplary embodiment, the first back mortise 126 is sized and shaped to receive the floor tenon 52. Edges 130 of the first back mortise 126 are configured to pressurably couple to the floor tenon 52. The second back mortise 128 is sized and shaped to receive the top tenon 108. Edges 132 of the second back mortise 128 are configured to pressurably couple to the top tenon 108.

Figure 5:
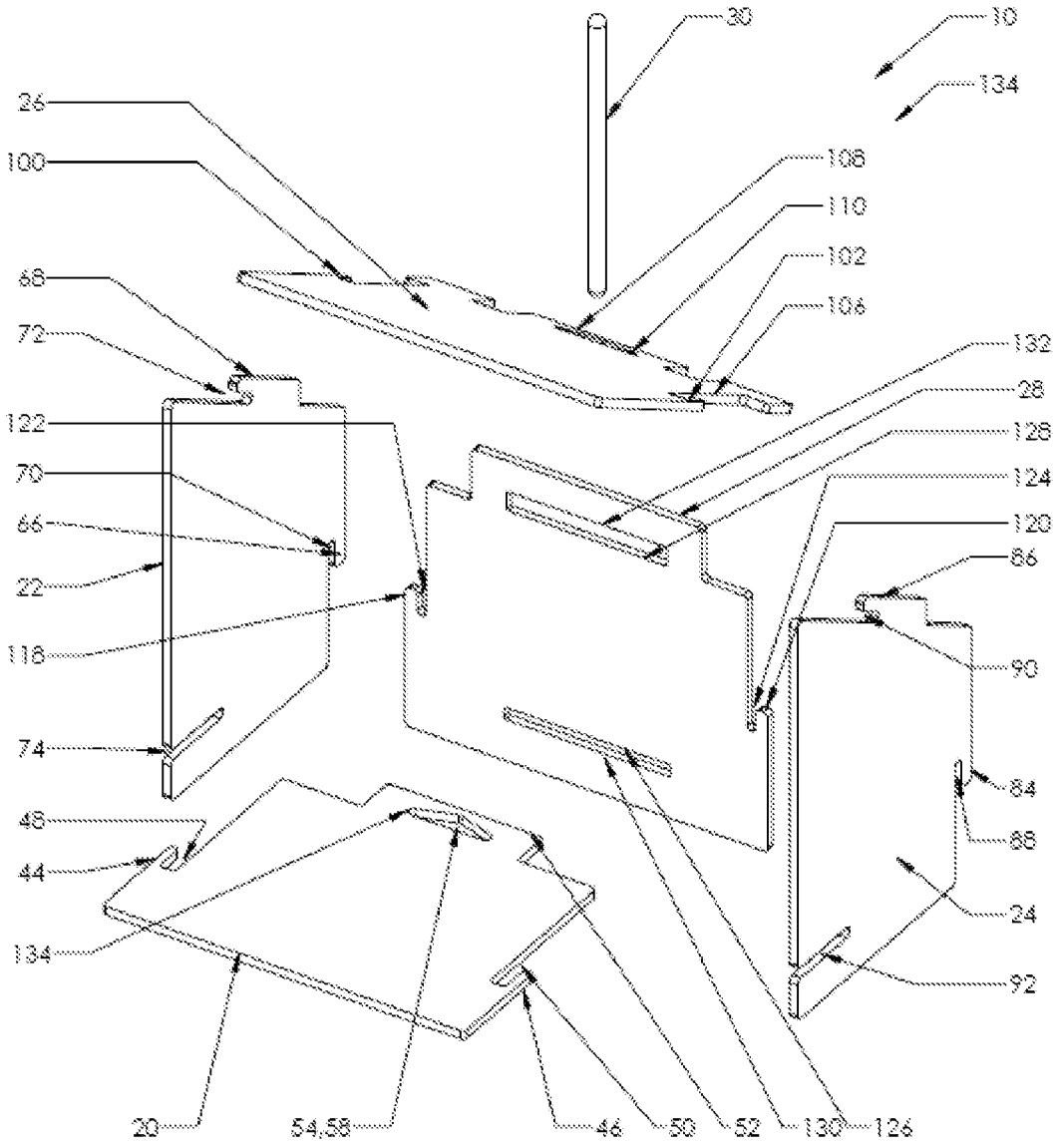
FIG. 5 is an assembly schematic view of the rod of FIG. 4*a* and the plurality of panels of FIGS. 4*b*-4*f* illustrated in a disassembled position.

FIG. 5 is an assembly schematic of the interlocking structure 10 in a disassembled position 134. Referring to FIGS. 1-5, during an exemplary assembly, the floor panel 20 is configured to removably couple to the back panel 28. More particularly, the floor tenon 52 inserts through the first back mortise 126 and extends beyond the back panel 28. In particular, the floor aperture 54 is located beyond the rear of the back panel 28. In this position, the floor tenon 52 removably couples with edges 130 of the first back mortise 126. Additionally, the first floor groove 48 is configured to insert within the third side groove 74 of the first side panel 22. In this position, the first floor tab 44 removably couples to the first side panel 22. The second floor groove 50 inserts within the third side groove 92 of the second side panel 24. In this position, the second floor tab 46 is configured to removably couple to the second side panel 24.

The first side panel 22 is configured to removably couple to the back panel 28. In particular, the first side groove 70 of the first side panel 22 inserts within the first back groove 122. In this position, the first side tab 66 removably couples to the back panel 28. Moreover, the first back tab 118 removably couples to the first side panel 22. The second side panel 24 is configured to removably couple to the back panel 28. In particular, the first side groove 88 of the second side panel 24 is configured to insert within the second back groove 124. In this position, the first side tab 84 is configured to removably couple to the back panel 28. Moreover, the second back tab 120 is configured to removably couple to the second side panel 24.

The top panel 26 removably couples to at least one of the first side panel 22, the second side panel 24, and the back panel 28. More particularly, the top tenon 108 inserts through the second back mortise 128 and beyond the back panel 28. In particular, the top aperture 110 is located beyond the rear of the back panel 28. In this position, the top tenon 108 removably couple to edges 132 of the second back mortise 128.

The second side groove 72 of the first side panel 22 inserts within the first top groove 100. In this position, the second side tab 68 of the first side panel 22 removably couples to the top panel 26. Moreover, the first top tab 100 removably couples to the first side panel 22. The second side groove 90 of the second side panel 24 inserts within the second top groove 106. In this position, the second side tab 86 removably couples to the top panel 26. Additionally, the second top tab 102 removably couples to the second side panel 24.

Referring to FIGS. 1-3, in the assembled position 12, the floor tenon 52 and the top tenon 108 are aligned. More particularly, the floor aperture 54 and the top aperture 110 are co-linearly aligned to receive the rod 30. The rod 30 is configured to removably insert through the top aperture 110 and through the floor aperture 54. In particular, the first end 32 inserts through the top aperture 110 and the floor aperture 54 and extends beyond the floor aperture 54. The second end 34 extends beyond the top aperture 110. The body 36 is located between the bottom aperture and the top aperture 110. The rod 30 is configured to pressurably couple to the floor panel 20 and the top panel 26. Additionally, the rod 30 is configured to removably couple to the back panel 28. When the rod 30 is passed through the floor aperture 54 and the top aperture 110, the rod 30 is pressurably wedged and firmly locks together the floor panel 20 and the top panel 26. The rod 30 also pressurably wedges against the back panel 28.

The triangle shapes 58 of the floor aperture 54 and the top aperture 110 are configured to conveniently, efficiently, and effectively receive the rod 30. Moreover, the triangular shapes 58 are configured to allow the rod 30 to pressurably move within the top aperture 110 and the floor aperture 54 to facilitate applying pressure to the rod 30. More particularly, the rod 30 can slightly move toward the narrow corners 134 of the respective apertures 54, 110 to allow the edges 56, 111 apply more pressure to the rod 30 for an effective fit. In the assembled position 12, the rod 30 is configured to stabilize the interlocking structure 10.

During an exemplary assembly, after the plurality of panels 16 is coupled together, the first end 32 of the rod 30 is conveniently slid through the top aperture 110 and through the floor aperture 54. The rod 30, in the assembled position 12, easily and efficiently couples the floor panel 20 and the top panel 26 to the back panel 28. During assembly, the rod 30 stabilizes the interlocking structure 10 without the use of any tools. Moreover, in the assembled position 12, the edges 56 of the floor aperture 54 and the edges 111 of the top aperture 110 further pressure the rod 30 to removably couple to the back panel 28. In the assembled position 12, the rod 30 is configured to reduce or eliminate disassembly of any particular panel of the plurality of panels 16. For disassembly, the rod 30 is conveniently slid out of the floor aperture 54 and the top aperture 110 to remove pressure applied to at least one of the floor panel 20, the top panel 26, and the back panel 28. The plurality of panels 16 is easily and efficiently decoupled from one another for convenient compact storage.

Figure 6:
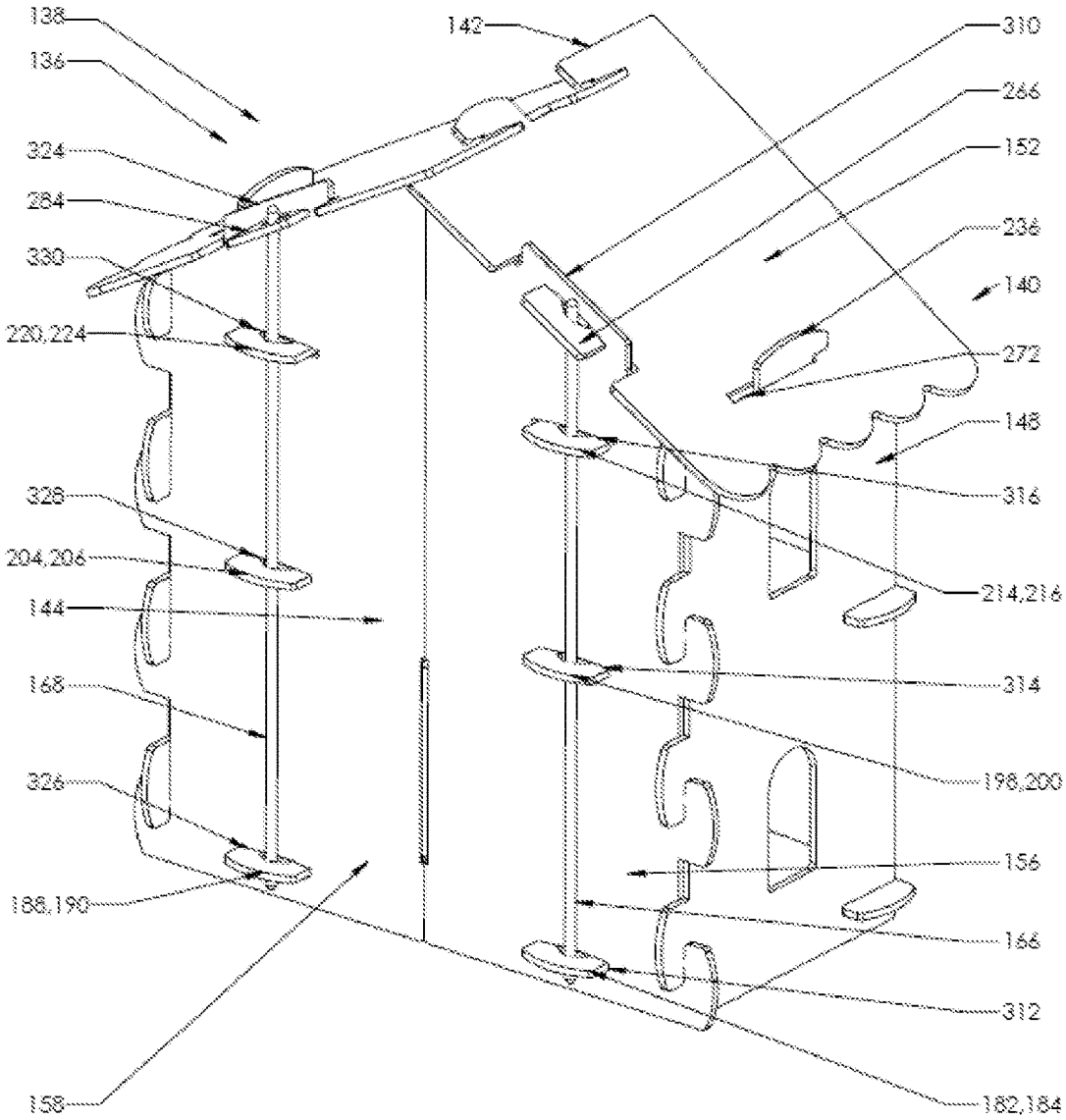
FIG. 6 is a rear perspective view of another exemplary interlocking structure of the present disclosure illustrated in an assembled position.
Figure 7:
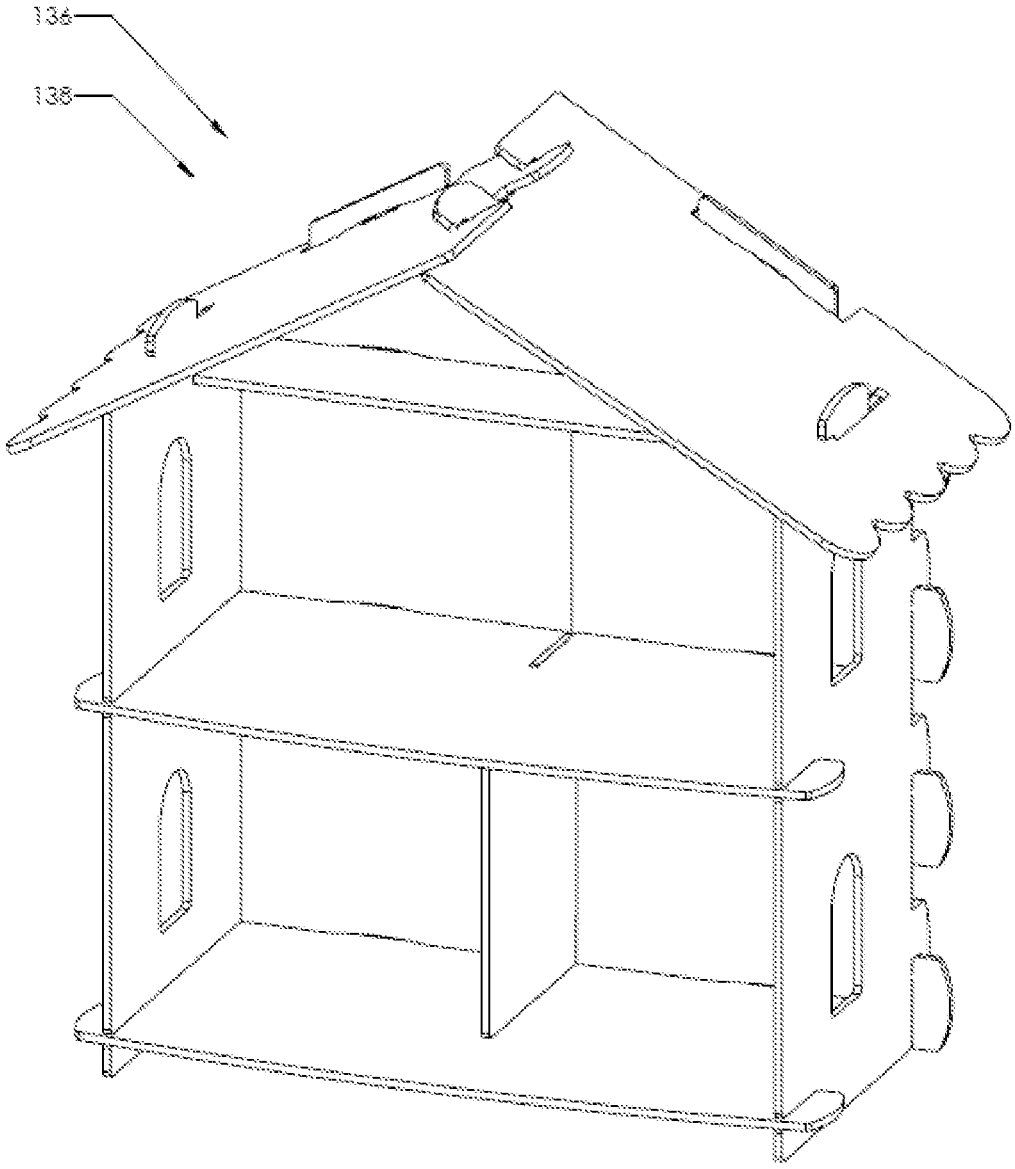
FIG. 7 is a front perspective view of the interlocking structure of FIG. 6.
Figure 8:
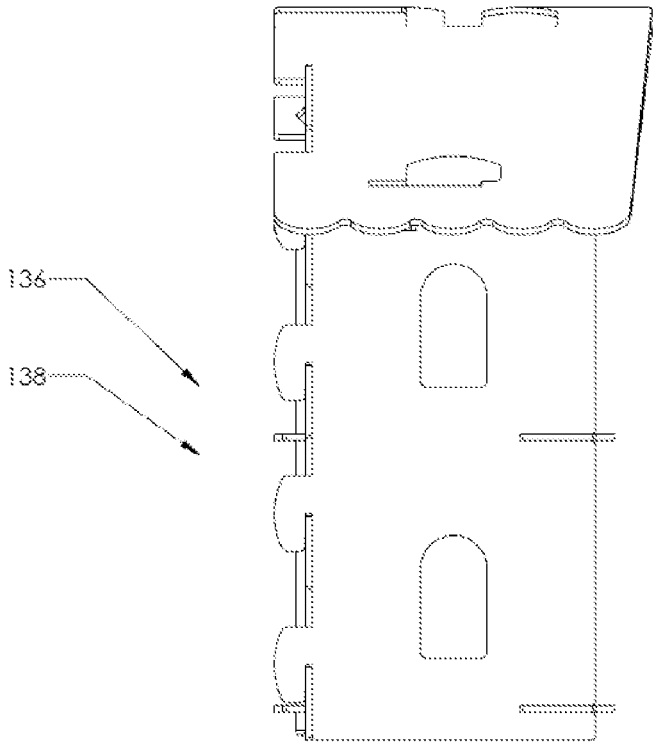
FIG. 8 is a side view of the interlocking structure of FIG. 6.
Figure 9:
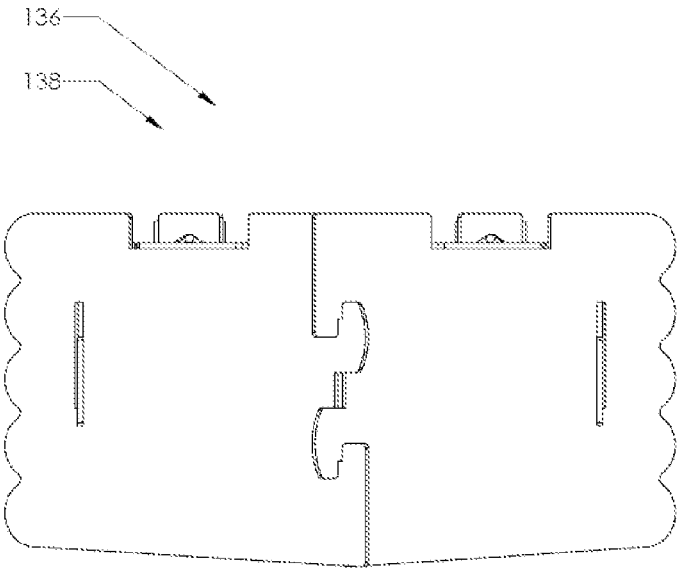
FIG. 9 is a top view of the interlocking structure of FIG. 6.

FIG. 6 is a rear perspective view of another interlocking structure 136, wherein the interlocking structure 136 is shown in an assembled position 138. FIG. 7 is a front perspective view of the interlocking structure 136. FIG. 8 is a side view of the interlocking structure 136. FIG. 9 is a top view of the interlocking structure 136. In FIGS. 6-9, similar components as shown in FIGS. 1-5 include the same element numbers as shown as in FIGS. 1-5. In the exemplary embodiment, the interlocking structure 136 includes a shape 140 of a house. Alternatively, the interlocking structure 136 can include any type of shape. The interlocking structure 136 includes a plurality of panels 142 and a compression fastener 144 which is configured to removably couple together at least two panels of the plurality of panels 142. Moreover, the plurality of panels 142 are configured to removably couple to each other without the need of an assembly tool such as, but not limited to, a screwdriver, a hammer, and glue.

Figure 10A:
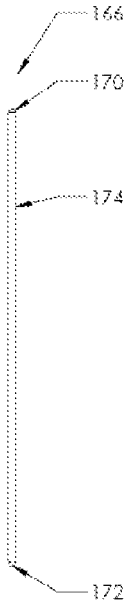
FIG. 10*a* is side view of a first rod of a compression fastener of the interlocking structure of FIG. 6.
Figure 10B:
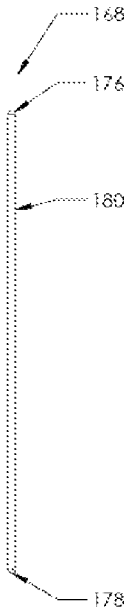
FIG. 10*b* is a side view of a second rod of a compression fastener of the interlocking structure of FIG. 6.

FIGS. 10*a* and 10*b* are side views of a first rod 166 and a second rod 168 respectively of the compression fastener 144, and FIGS. 10*c*-10*l* are views of the panels of the plurality of panels 142 of the structure 136. In FIGS. 10*a*-10*l*, similar components as shown in FIGS. 1-9 include the same element numbers as shown as in FIGS. 1-9. In the exemplary embodiment, the plurality of panels 142 include a floor panel 146, a first side panel 148, a second side panel 150, a first top panel 152, a second top panel 154, a first back panel 156, and a second back panel 158. Moreover, the plurality of panels 142 include an intermediate floor panel 160, a loft panel 162, and a partition panel 164. FIG. 10*a* is side view of the first rod 166 of the compression fastener 144. FIG. 10*b* is a side view of the second rod 168 of the interlocking structure of FIG. 6. In the exemplary embodiment, the first rod 166 includes a first end 170, a second end 172, and a body 174 located between the first end 170 and the second end 172. The second rod 168 includes a first end 176, a second end 178, and a body 180 located between the first end 176 and the second end 178. The first rod 166 is selectively coupled to at least one of the floor panel 146, the first top panel 152, and the first back panel 156 to maintain assembly of the interlocking structure 136. The second rod 168 is selectively coupled to at least one of the floor panel 146, the second top panel 154, and the second back panel 158 to further maintain assembly of the interlocking structure 136.

Figure 10C:
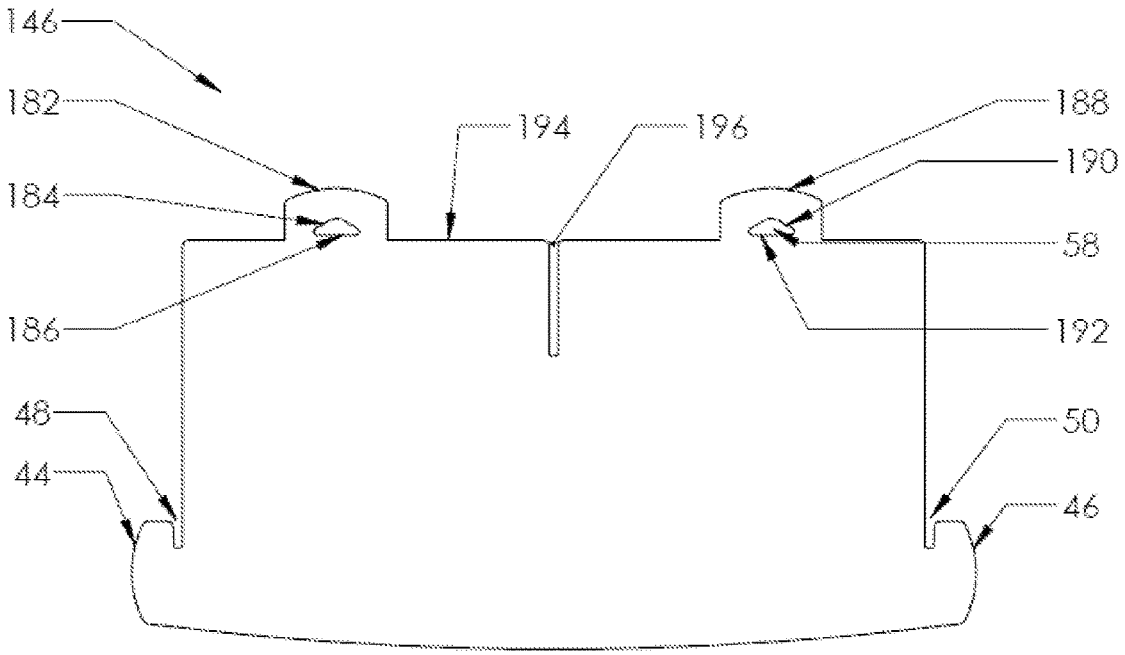
FIG. 10*c* is a plan view of a floor panel of the interlocking structure of FIG. 6.

FIG. 10*c* is a plan view of the floor panel 146 of the interlocking structure of FIG. 6. The floor panel 146 includes a first floor tenon 182 having a first floor aperture 184 defined by edges 186. Additionally, the floor panel 146 includes a second floor tenon 188 having a second floor aperture 190 defined by edges 192. Apertures 184, 190 include the triangle shape 58. In the exemplary embodiment, a floor groove 196 begins at an edge 194 and extends into the floor panel 146. Moreover, the floor panel 146 includes tabs 44, 46 and grooves 48, 50.

Figure 10D:
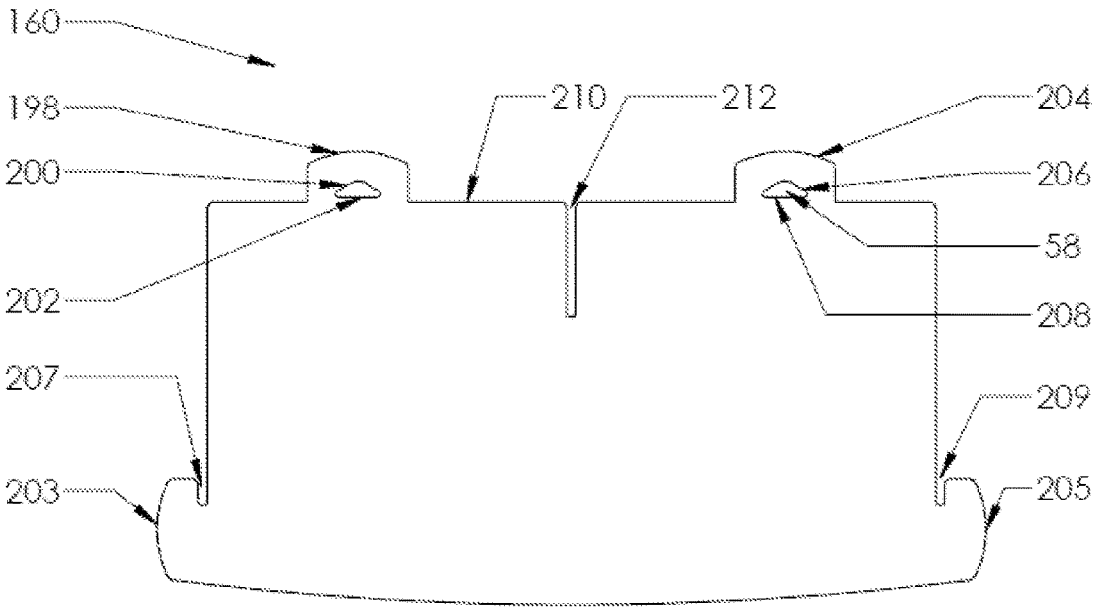
FIG. 10*d* is a is plan view of an intermediate floor panel of the interlocking structure of FIG. 6.

FIG. 10*d* is a plan view of the intermediate floor panel 160 of the interlocking structure of FIG. 6. The intermediate floor panel 160 includes a first intermediate tenon 198 having a first intermediate aperture 200 defined by edges 202. The intermediate floor panel 160 further includes a second intermediate tenon 204 having a second intermediate aperture 206 defined by edges 208. Apertures 200, 206 include the triangle shape 58. In the exemplary embodiment, an intermediate groove 212 begins at an edge 210 and extends into the intermediate floor panel 160. Moreover, the intermediate floor panel 160 includes tabs 203, 205 and grooves 207, 209.

Figure 10E:
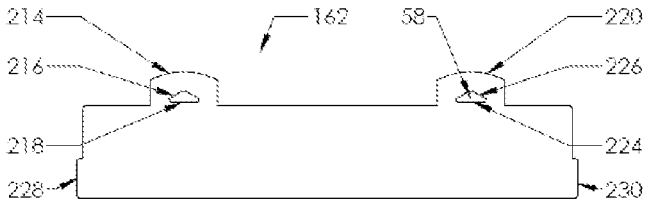
FIG. 10*e* is a plan view of a loft panel of the interlocking structure of FIG. 6.

FIG. 10*e* is a plan view of the loft panel 162 of the interlocking structure of FIG. 6. The loft panel 162 includes a first loft tenon 214 having a first loft aperture 216 defined by edges 218. The loft panel 162 further includes a second loft tenon 220 having a second loft aperture 224 defined by edges 226. Apertures 216, 224 include the triangle shape 58. The loft panel 162 includes a first loft tab 228 and a second loft tab 230.

Figure 10F:
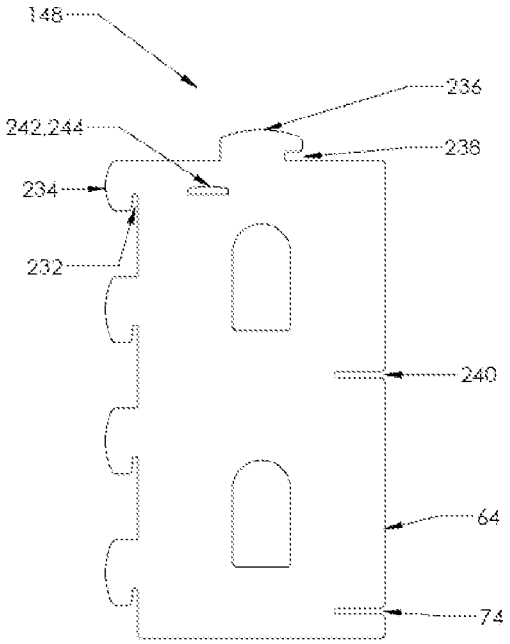
FIG. 10*f* is a side view of a first side panel of the interlocking structure of FIG. 6.

FIG. 10*f* is a side view of the first side panel 148 of the interlocking structure of FIG. 6. The first side panel 148 includes a plurality of grooves 232 and a plurality of respective tabs 234. The first side panel 148 further includes a top tab 236 and a top groove 238. Moreover, the first side panel 148 includes the groove 74 and a first intermediate groove 240 extending from the edge 64 and into the first side panel 148. Additionally, a first loft slot 242 is defined through the first side panel 148. In the exemplary embodiment, the first loft slot 242 is sized and shaped to receive the first loft tab 228. More particularly, edges 244 of the first loft slot 242 are configured to removably couple to the first loft tab 228.

Figure 10G:
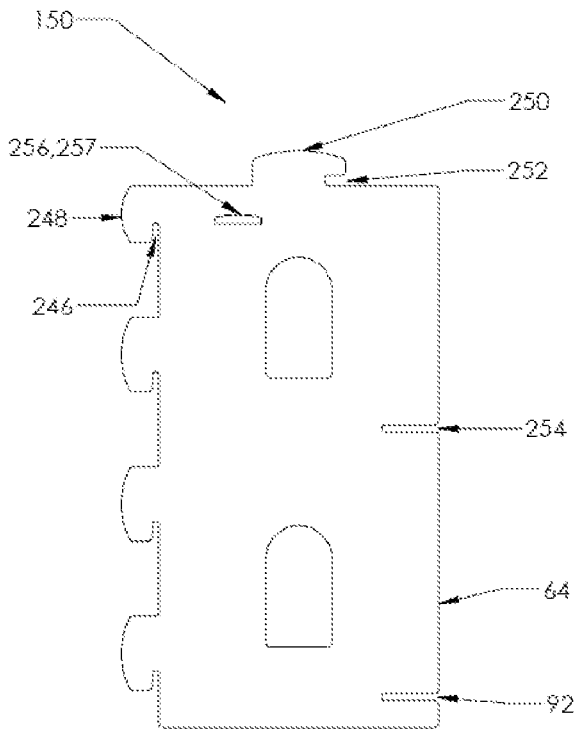
FIG. 10*g* is a side view of a second side panel of the interlocking structure of FIG. 6.

FIG. 10*g* is a side view of the second side panel 150 of the interlocking structure of FIG. 6. The second side panel 150 includes a plurality of grooves 246 and a plurality of respective tabs 248. The second side panel 150 further includes a top tab 250 and a top groove 252. Moreover, the second side panel 150 includes the groove 92 and a second intermediate groove 254 extending from the edge 64 and into the second side panel 150. Additionally, a second loft slot 256 is defined through the second side panel 150. In the exemplary embodiment, the second loft slot 256 is sized and shaped to receive the second loft tab 230. More particularly, edges 257 of the second loft slot 256 are configured to removably couple to the second loft tab 230.

Figure 10H:
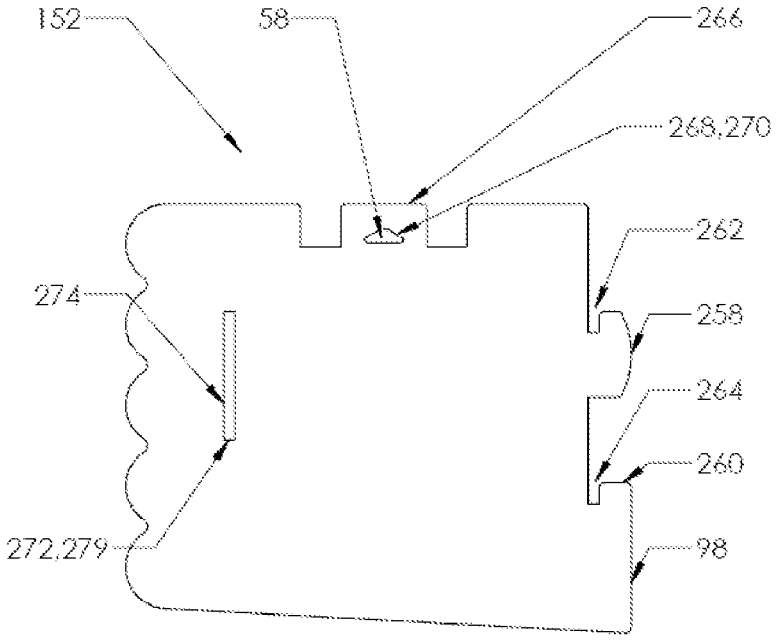
FIG. 10*h* is a plan view of a first top panel of the interlocking structure of FIG. 6.

FIG. 10*h* is a plan view of the first top panel 152 of the interlocking structure of FIG. 6. The first top panel 152 includes a first top tab 258 and a second top tab 260. A first top groove 262 is located between the side edge 98 and the first top tab 258; and, a second top groove 264 is located between the side edge 98 and the second top tab 260. As illustrated, the first top panel 152 includes a top tenon 266 extending out from the edge 98. The top tenon 266 includes a top aperture 268 defined by edges 270 and includes the triangle shape 58. The first top panel 152 also includes a first top slot 272 defined there through. In the exemplary embodiment, the first top slot 272 is sized and shaped to receive the top tab 236 of the first side panel 148. More particularly, edges 279 of the first top slot 272 are configured to removably couple to the top tab 236.

Figure 10I:
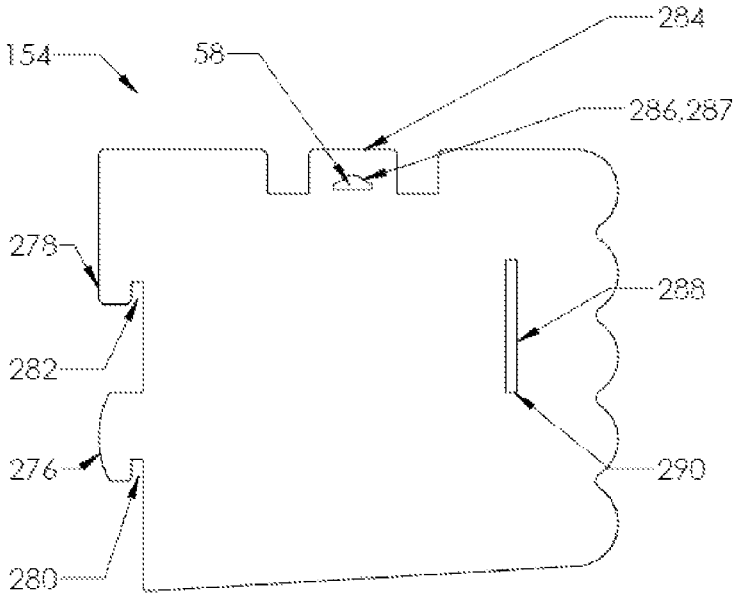
FIG. 10*i* is a plan view of a second top panel of the interlocking structure of FIG. 6.

FIG. 10*i* is a plan view of the second top panel 154 of the interlocking structure of FIG. 6. The second top panel 154 includes a first top tab 276 and a second top tab 278. A first top groove 280 is located between a side edge and the first top tab 276; and, a second top groove 282 is located between the side edge and the second top tab 278. As illustrated, the second top panel 154 includes a top tenon 284 extending out from the edge. The top tenon 284 includes a top aperture 286 defined by edges 287 and includes the triangle shape 58. The second top panel 154 also includes a second top slot 288 defined there through. In the exemplary embodiment, the second top slot 288 is sized and shaped to receive the top tab 250 of the second side panel 150. More particularly, edges 290 of the second top slot 288 are configured to removably couple to the top tab 250. In the exemplary embodiment, the first tab 258 and the first groove 262 of the first top panel 152 are configured to removably couple to the first top tab 276 and the first groove 280 of the second top panel 154. Moreover, the second top tab 260 and the second top groove 264 of the first top panel 152 are configured to removably couple to the second top tab 278 and the second top groove 282 of the second top panel 154.

Figure 10J:
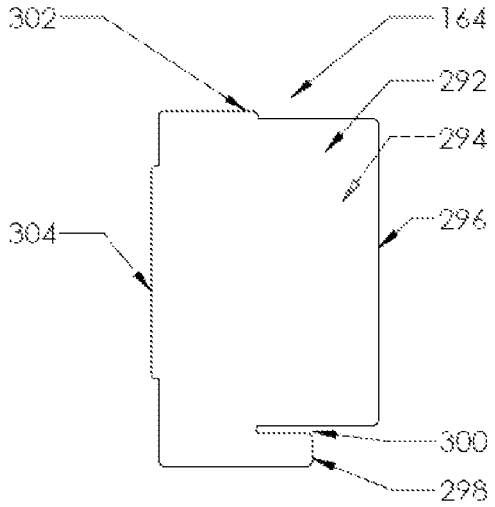
FIG. 10*j* is a plan view of a partition panel of the interlocking structure of FIG. 6.

FIG. 10*j* is a plan view of the partition panel 164 of the interlocking structure of FIG. 6. As illustrated, the partition panel 164 includes a first side 292, a second side 294, and side edges 296 connecting the first side 292 and the second side 294. Additionally, the partition panel 164 includes a first partition tab 298 that is spaced from the side edge by a first partition groove 300. The partition panel 164 further includes a second partition tab 302 and a third partition tab 304 which extend outward from the side edge 296.

Figure 10K:
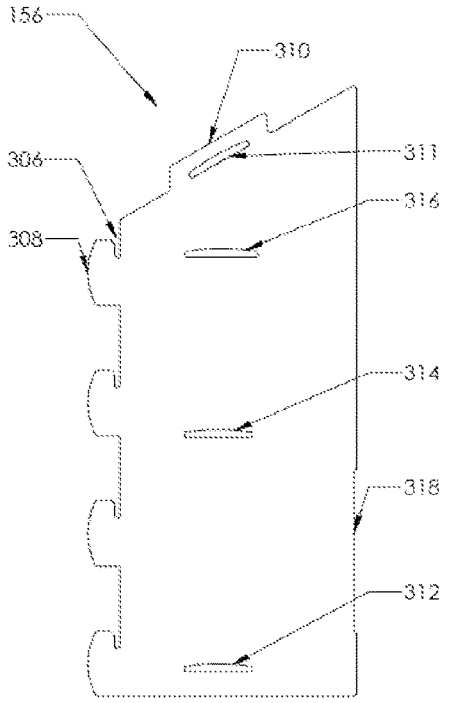
FIG. 10*k* is a plan view of a first back panel of the interlocking structure of FIG. 6.

FIG. 10*k* is a plan view of the first back panel 156 of the interlocking structure of FIG. 6. The first back panel 156 includes a plurality of grooves 306 and a plurality of respective tabs 308. The first back panel 156 further includes a top tab 310 having a slot 311. Moreover, the first back panel 156 includes a back mortise 312, an intermediate mortise 314, and a loft mortise 316 defined there through. The back mortise 312 is sized and shaped to receive the first floor tenon 182. More particularly, edges of the back mortise 312 are configured to removably couple to the first floor tenon 182. The intermediate mortise 314 is sized and shaped to receive the first intermediate tenon 198. Edges of the intermediate mortise 314 are configured to removably couple to the first intermediate tenon 198. The loft mortise 316 is sized and shaped to receive the first loft tenon 214. Edges of the loft mortise 316 are configured to pressurably couple to the first loft tenon 214. First back panel 156 further includes a groove 318 that extends from the edge and toward the plurality of tabs 308. In the exemplary embodiment, the groove 318 is configured to receive the third partition tab 304.

Figure 10L:
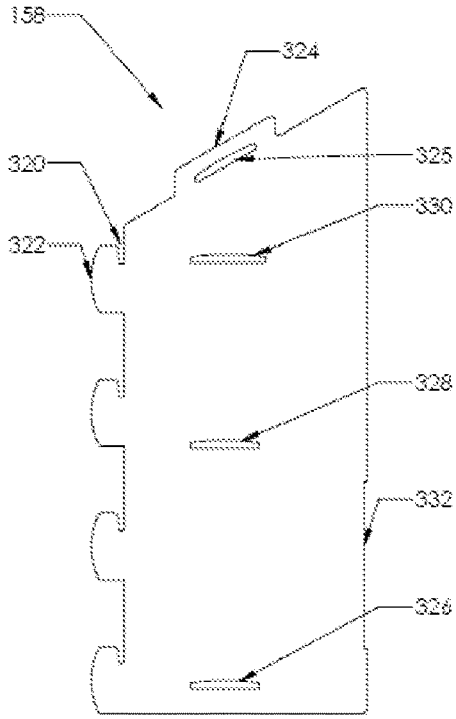
FIG. 10*l* is a plan view of a second back panel of the interlocking structure of FIG. 6.

FIG. 10*l* is a plan view of the second back panel 158 of the interlocking structure of FIG. 6. The second back panel 158 includes a plurality of grooves 320 and a plurality of respective tabs 322. The second back panel 158 further includes a top tab 324 having a slot 325. Moreover, the second back panel 158 includes a back mortise 326, an intermediate mortise 328, and a loft mortise 330 defined there through. The back mortise 326 is sized and shaped to receive the second floor tenon 188. More particularly, edges of the back mortise 326 are configured to removably couple to the second floor tenon 188. The intermediate mortise 328 is sized and shaped to receive the second intermediate tenon 204. Edges of the intermediate mortise 328 are configured to removably couple to the second intermediate tenon 204. The loft mortise 330 is sized and shaped to receive the second loft tenon 220. Edges of the loft mortise 330 are configured to removably couple to the second loft tenon 220. The second back panel 158 further includes a groove 332 that extends from the edge and toward the plurality of tabs 322. In the exemplary embodiment, the groove 332 is configured to receive the third partition tab 304.

Figure 11:
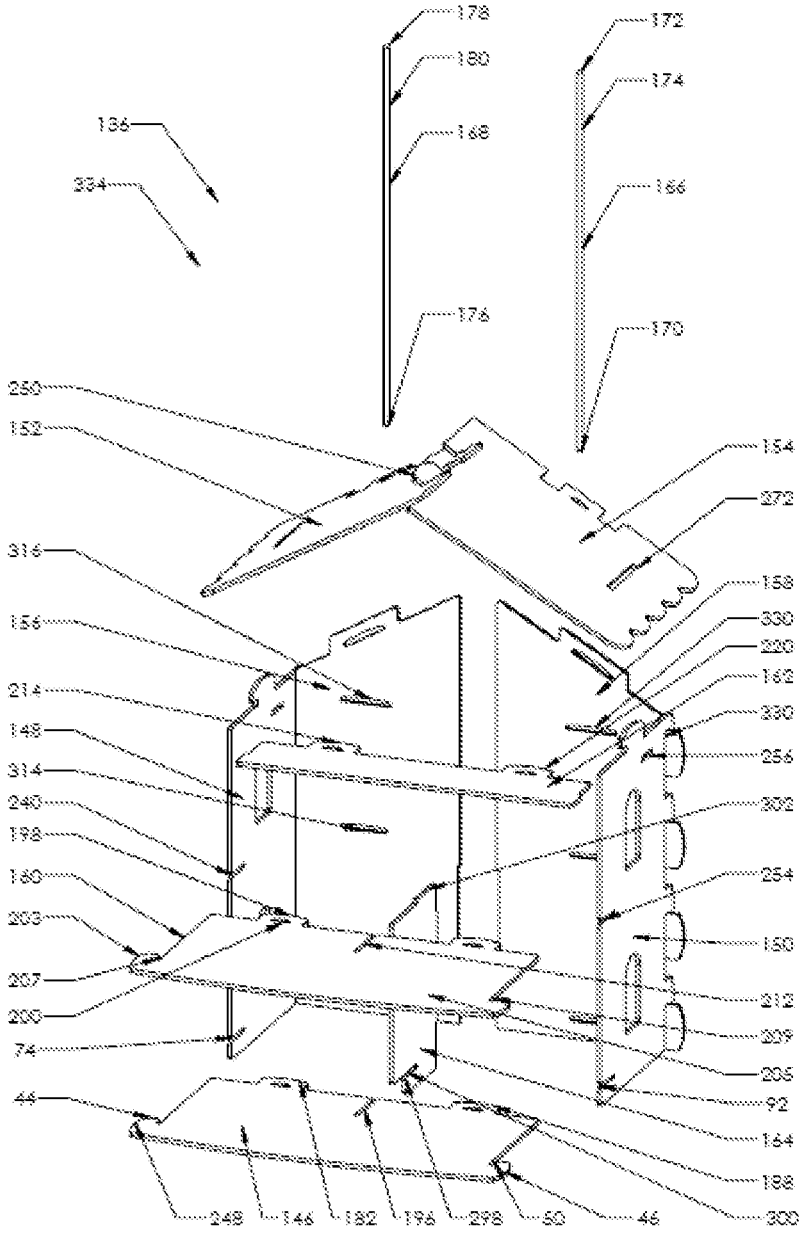
FIG. 11 is an assembly schematic view of the first and second rods of FIGS. 10*a* and 10*b* and the plurality of panels of FIGS. 10*c*-10*l* illustrated in a disassembled position.

FIG. 11 is an assembly schematic of the interlocking structure 136 in a disassembled position 334. In FIG. 11, similar components as shown in FIGS. 1-10 include the same element numbers as shown as in FIGS. 1-10. Referring to FIGS. 6-11, during an exemplary assembly, the floor panel 146 removably couples to the first back panel 156, the second back panel 158, and the partition panel 164. The floor panel 146 also removably couples to the first side panel 148 and the second side panel 150. More particularly, the floor groove 196 inserts into the first partition groove 300 such that the first partition tab 298 removably couples to the floor panel 146. As previously described, grooves 48, 50 insert into grooves 74, 92 of the first side panel 148 and the second side panel 150 respectively. Additionally, the tabs 44, 46 removably couple to the first side panel 148 and the second side panel 150 respectively.

The first floor tenon 182 inserts through the back mortise 312 of the first back panel 156. In particular, the first floor aperture 184 is located beyond the rear of the first back panel 156. In this position, the first floor tenon 182 removably couples to the edges of the back mortise 312 of the first back panel 156. The second floor tenon 188 inserts through the back mortise 326 of the second back panel 158. The second floor aperture 190 is located beyond the rear of the second back panel 158. In this position, the second floor tenon 188 removably couples to the edges of the back mortise 326 of the second back panel 158.

The intermediate floor panel 160 removably couples to the first back panel 156, the second back panel 158, and the partition panel 164. Additionally, the intermediate floor panel 160 removably couples to the first side panel 148 and the second side panel 150. More particularly, the second partition tab 302 inserts into the intermediate groove 212. Intermediate grooves 207, 209, insert within grooves 240, 254 of the first side panel 148 and the second side panel 150 respectively. Additionally, the intermediate tabs 203, 205 removably couple to the first side panel 148 and the second side panel 150 respectively.

The first intermediate tenon 198 inserts through the intermediate mortise 314 of the first back panel 156. In particular, the first intermediate aperture 200 is located beyond the rear of the first back panel 156. In this position, the first intermediate tenon 198 removably couples to the edges of the intermediate mortise 314 of the first back panel 156. The second intermediate tenon 204 inserts through the intermediate mortise 328 of the second back panel 158. In particular, the second intermediate aperture 206 is located beyond the rear of the second back panel 158. In this position, the second intermediate tenon 204 removably couples to the edges of the intermediate mortise 328 of the second back panel 158.

The loft panel 162 removably couples to the first side panel 148, the second side panel 150, the first back panel 156, and the second back panel 158. The first loft tenon 214 inserts through the loft mortise 316 of the first back panel 156. In particular, the first loft aperture 216 is located beyond the rear of the first back panel 156. In this position, the first loft tenon 214 removably couples to the edges of the loft mortise 316 of the first back panel 156. The second loft tenon 220 inserts though the loft mortise 330 of the second back panel 158. In particular, the second loft aperture 224 is located beyond the rear of the second back panel 158. In this position, the second loft tenon 220 removably couples to the edges of the loft mortise 330 of the second back panel 158. Moreover, the first loft tab 228 inserts through the first loft slot 242 and removably couples to edges thereto. The second loft tab 230 inserts through the second loft slot 256 and removably couples thereto.

The first side panel 148 removably couples to the first top panel 152 and the first back panel 156. The plurality of grooves 232 inserts into the plurality of grooves 306 of the first back panel 156. Moreover, the plurality of tabs 234 removably couple to the plurality of tabs 308 of the first back panel 156. The top tab 236 inserts the first top slot 272 of the first top panel 152. Edges 279 of the first top slot 272 removably couple to the top tab 236.

The second side panel 150 removably couples to the second top panel 154 and the second back panel 158. The plurality of grooves 246 insert into the plurality of grooves 320 of the second back panel 158. Moreover, the plurality of tabs 248 removably couple to the plurality of tabs 322 of the second back panel 158. The top tab 250 inserts through the second top slot 288 of the second top panel 154. Edges 290 of the second top slot 288 removably couple to the top tab 250.

The first top panel 152 removably couples to the first side panel 148. As illustrated and described, edges of the first top slot 272 removably couple to the top tab 236. Additionally, the second top panel 154 removably couples to the second side panel 150, wherein edges 290 of the second top slot 288 removably couple to the top tab 250. The first tab 258 and the first groove 262 of the first top panel 152 removably couples to the first tab 260 and the first groove 264 of the second top panel 154. In this position, the top tenon 266 and associated first top aperture 268 extend beyond the rear of the first back panel 156. Additionally, the top tenon 284 and associated second top aperture 286 extend beyond the rear of the second back panel 158. During the exemplary assembly, the third partition tab 304 inserts through and couples to the grooves 318, 332 of the first back panel 156 and the second back panel 158 respectively. Moreover, the top tenon 266 inserts through and couples to the slot 311 of the top tab 310 of the first back panel 156. The tenon 284 inserts through and couples to the top tab 324 of the second back panel 158.

Referring to FIGS. 6-10, in the assembled position 138, the top tenon 266 is orientated at an angle with respect to the first floor tenon 182 and the first intermediate tenon 198. The first floor aperture 184, the first intermediate aperture 200, the first loft aperture 216, and the first top aperture 268 are co-linearly aligned to receive the first rod 166. The first rod 166 is configured to removably insert through the first top aperture 268, the first intermediate aperture 200, the first loft aperture 216, and the first floor aperture 184. In particular, the first end 170 inserts through the first top aperture 268 and the first intermediate aperture 200, and extends beyond the first floor aperture 184. The second end 172 extends beyond the first top aperture 268. The body 174 is located between the first floor aperture 184 and the top aperture 268. The first rod 166 is configured to pressurably couple to the floor panel 146, the intermediate floor panel 160, and the first top panel 152. Additionally, the first rod 166 is configured to removably couple to the first back panel 156.

The triangle shapes 58 of the first floor aperture 184, the first intermediate aperture 200, the second loft aperture 216, and the top aperture 268 are configured to conveniently, efficiently, and effectively receive the first rod 166. Moreover, the triangular shapes 58 are configured to allow the first rod 166 to pressurably move within the first top aperture 268, the second loft aperture 216, the first intermediate aperture 198, and the first floor aperture 189 to facilitate applying pressure to the first rod 166. In the assembled position 138, the first rod 166 is configured to stabilize the interlocking structure 136 without the use of any tools. Moreover, in the assembled position 138, the edges of the first floor aperture 184, the first intermediate aperture 200, the second loft aperture 216, and the first top aperture 268 further pressure the first rod 166 to removably couple to the first back panel 156. In the assembled position 138, the first rod 166 is configured to reduce or eliminate disassembly of any particular panel of the plurality of panels 192.

The second rod 168 is configured to removably insert through the second top aperture 268, the second loft aperture 216, the second intermediate aperture 206, and through the second floor aperture 190. In particular, the first end 176 inserts through the second top aperture 268, the second loft aperture 216, and the second intermediate aperture 206, and extends beyond the second floor aperture 190. The second end 178 extends beyond the second top aperture 268. The body 180 is located between the second floor aperture 190 and the second top aperture 268. The second rod 168 is configured to pressurably couple to the floor panel 146, the intermediate floor panel 160, and the second top panel 154. Additionally, the second rod 168 is configured to removably couple to the second back panel 158.

The triangle shapes 58 of the second floor aperture 190, the second intermediate aperture 206, the second loft aperture 224, and the second top aperture 268 are configured to conveniently, efficiently, and effectively receive the second rod 168. Moreover, the triangular shapes 58 are configured to allow the second rod 168 to pressurably move within the second top aperture 268, the second intermediate aperture 206, the second loft aperture 224, and the second floor aperture 190 to facilitate applying pressure to the second rod 168. In the assembled position 138, the second rod 168 is configured to stabilize the interlocking structure 136 without the use of any tools. Moreover, in the assembled position 138, the edges of the second floor aperture 190, the second intermediate aperture 206, the second loft aperture 224, and the second top aperture 268 further pressure the second rod 168 to removably couple to the second back panel 158. In the assembled position 138, the second rod 168 is configured to reduce or eliminate disassembly of any particular panel of the plurality of panels 192.

Figure 12A:
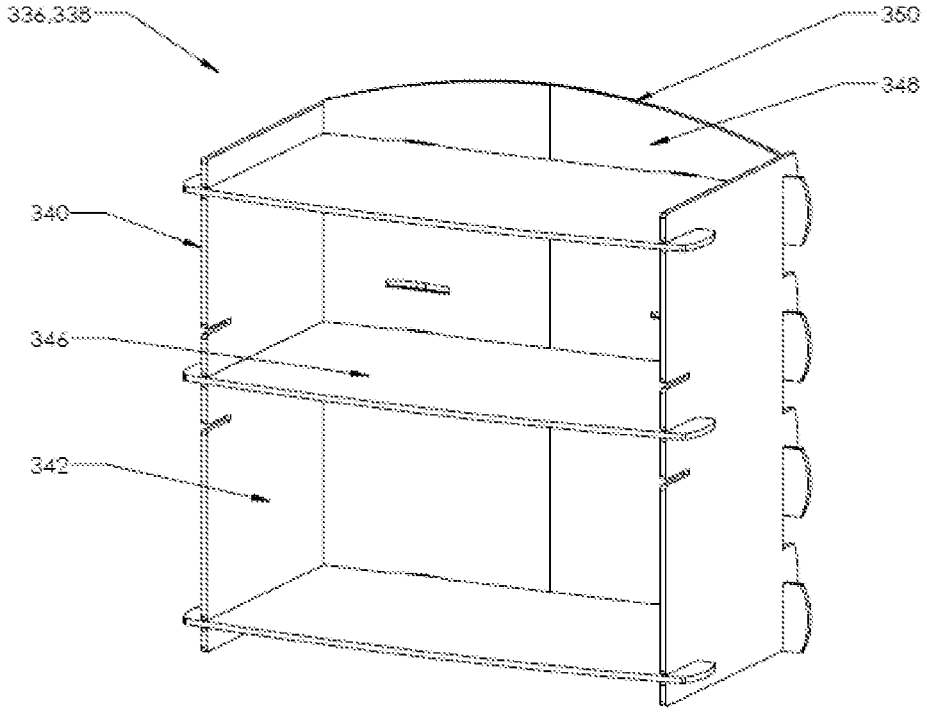
FIG. 12*a* is a front perspective view of another exemplary interlocking structure of the present disclosure in an assembled position.
Figure 12B:
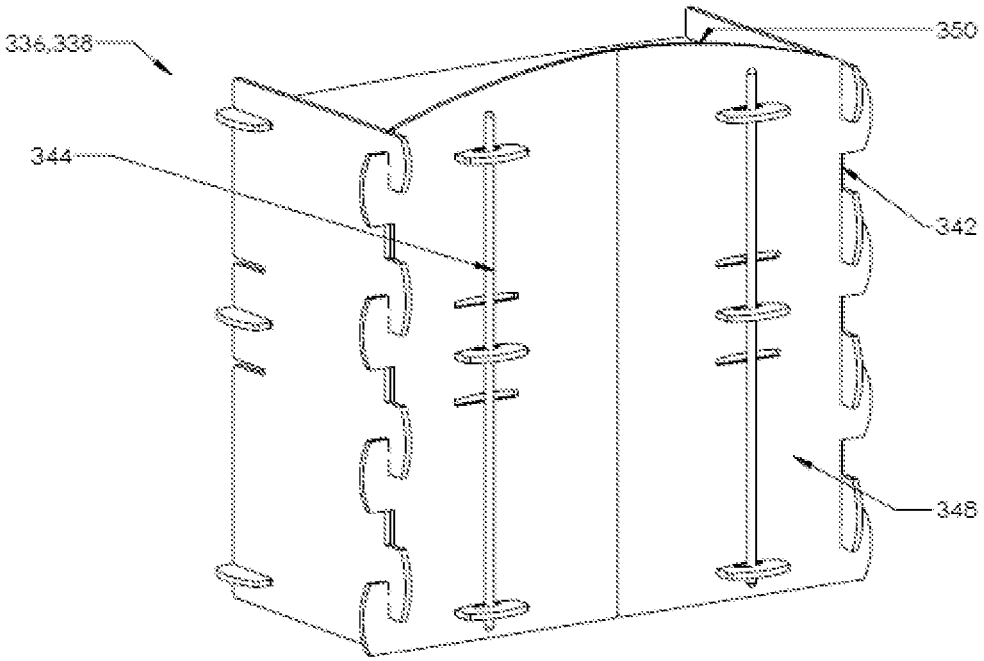
FIG. 12*b* is a rear perspective view of the interlocking structure shown in FIG. 12*a;*

FIG. 12*a* is front perspective view of an interlocking structure 336 shown in an assembled position 338. FIG. 12*b* is a rear perspective view of the interlocking structure 336. In the exemplary embodiment, the interlocking structure 336 includes a shape 340 of a bookshelf. Alternatively, the interlocking structure 336 can include any type of shape. The interlocking structure 336 includes a plurality of panels 342 and at least one compression fastener 344 which is configured to removably couple together at least two panels of the plurality of panels 342. Moreover, the plurality of panels 342 are configured to removably couple to each other without the need of an assembly tool such as, but not limited to, a screwdriver, a hammer, and glue. The plurality of panels 342 includes a plurality of floor panels 346. Moreover, the plurality of panels 342 includes a plurality of back panels 348 coupled to the floor panels 346 by the at least one compression fastener 344. In the exemplary embodiment, the back panels 348 include curvilinear ends 350.

Figure 13A:
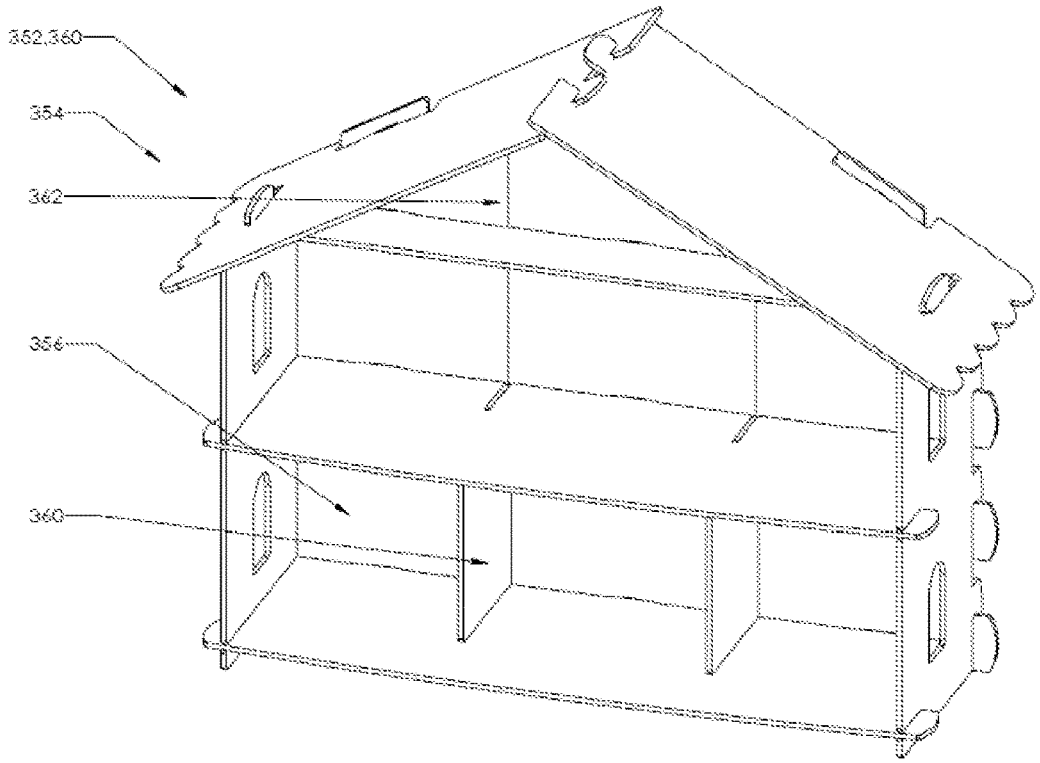
FIG. 13*a* is a front perspective view of another exemplary interlocking structure of the present disclosure in an assembled position.
Figure 13B:
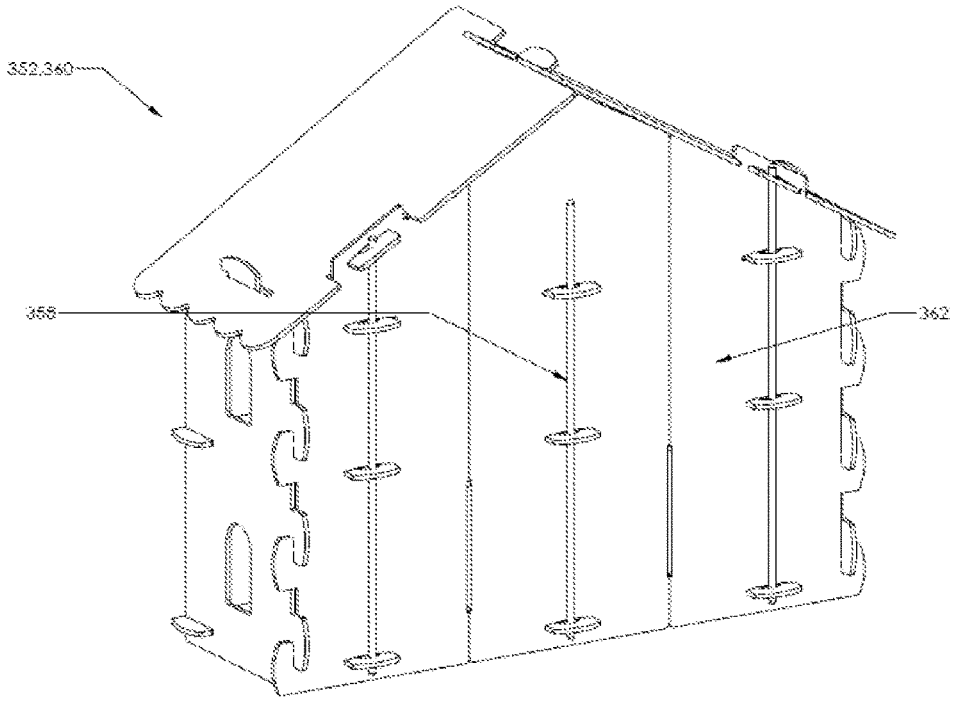
FIG. 13*b* is a rear perspective view of the interlocking structure shown in FIG. 13*a*.

FIG. 13*a* is front perspective view of an interlocking structure 352 shown in an assembled position 360. FIG. 13*b* is a rear perspective view of the interlocking structure 352. In the exemplary embodiment, the interlocking structure 352 includes a shape 354 of a house. Alternatively, the interlocking structure 352 can include any type of shape. The interlocking structure 352 includes a plurality of panels 356 and at least one compression fastener 358 which is configured to removably couple together at least two panels of the plurality of panels 356. Moreover, the plurality of panels 356 are configured to removably couple to each other without the need of an assembly tool such as, but not limited to, a screwdriver, a hammer, and glue. The plurality of panels 356 includes a plurality of intermediate panels 360. Moreover, the plurality of panels 356 includes a plurality of back panels 362 coupled to the intermediate panels 360.

Figure 14:
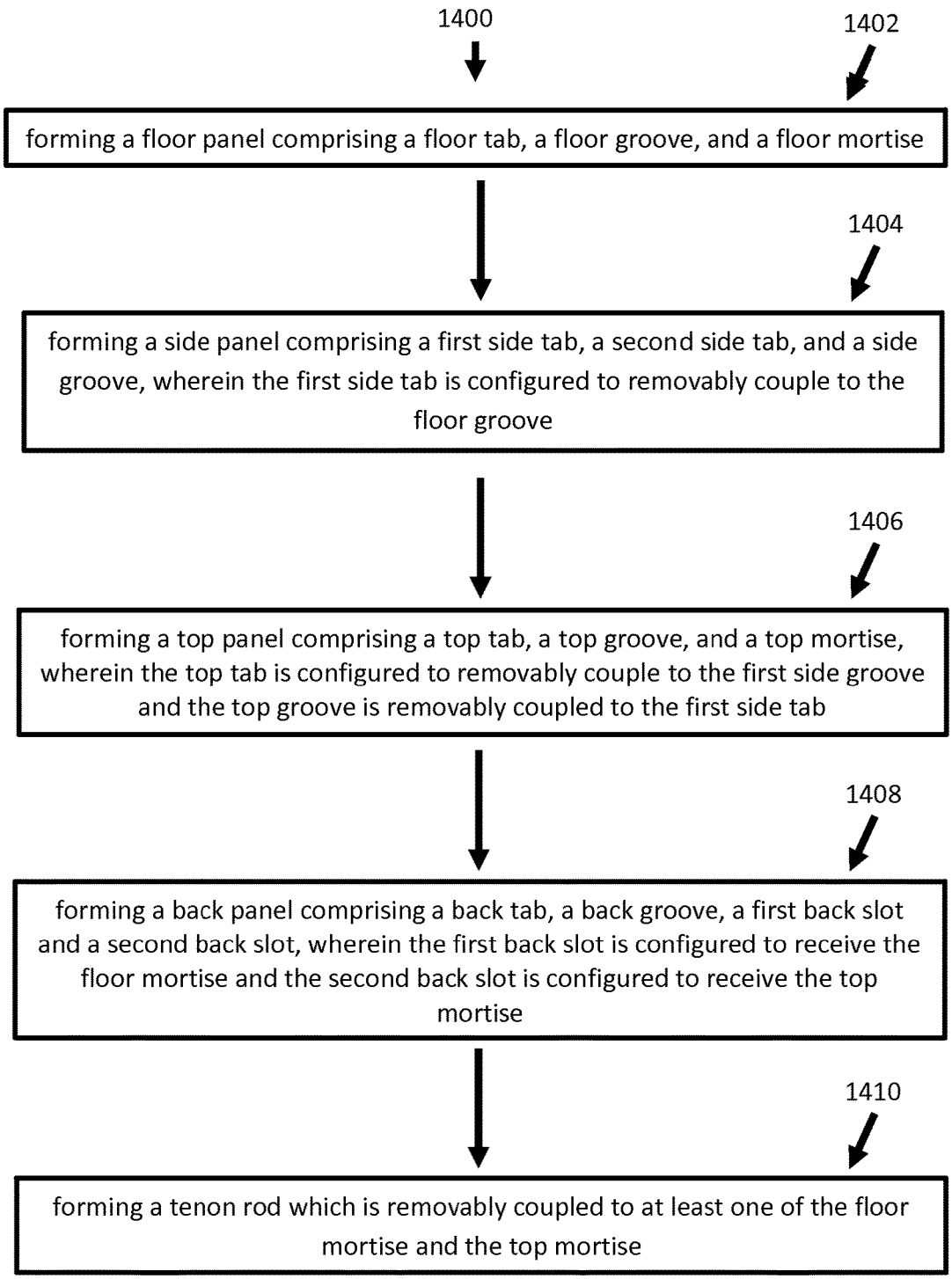
FIG. 14 is a flowchart illustrating an exemplary method of assembling the interlocking structure illustrated in FIG. 1.

FIG. 14 is a flowchart illustrating an exemplary method 1400 of assembling an interlocking structure, such as the interlocking structure 10 (shown in FIG. 1). Method 1400 includes forming 1402 a floor panel which has a floor tab, a floor groove, and a floor tenon such as the floor tab 44, the floor groove 48, and the floor tenon 82 (all shown in FIG. 5). Moreover, in the exemplary method 1400, a side panel, for example side panel 22 (shown in FIG. 5) is formed 1404, wherein the side panel includes the first side tab 66, the second side tab 68, and the side groove 70 (all shown in FIG. 5). The first side tab is configured to removably couple to the side groove. The method 1400 includes forming 1406 a top panel having a top tab, a top groove, and a top tenon, for example the top tab 100, the top groove 104, and the top tenon 108 (all shown in FIG. 5). The top tab is configured to removably couple to the first side groove and the top groove is removably coupled to the first side tab. A back panel, for example the back panel 28 (shown in FIG. 5), is formed 1408 and includes a back tab, a back groove, a first back mortise and a second back mortise, such as the back tab 118, the back groove 142, the first back mortise 146, and the second back mortise 148 (all shown in FIG. 5). The first back mortise is configured to receive the floor tenon and the second back mortise is configured to receive the top tenon. The method 1400 further includes forming 1410 a rod, for example the rod 30 (shown in FIG. 5), which is configured to removably couple to the at least one of the floor tenon and the top tenon.

The embodiments described herein relate to a toy structure that is easily and efficiently assembled and disassembled without the use of tools. The embodiments described herein relate to improved interconnecting techniques for manufacture and assembly of toy interlocking structures. The plurality of panels can be precisely and efficiently cut by CNC routers from large sheets of material with reduced or minimal by-product wastes. The embodiments are made from a plurality of panels that can be mass produced in a cost effective way. The plurality of panels are designed to fit together using multiple different construction joints to create a harmonious interlocking toy structure that is sturdy and rigid. When disassembled, the interlocking structure panels stack flat and assume minimal storage space. The embodiments described herein use a variety of construction joints such as open ended slots, tabs, and mortise and rod connections. The mortise and rod can lock one or more panels together. In the embodiments described herein, the rod may include configurations or structures such as, but not limited to, a tab, a peg, a key, a protrusion, and a leg. Moreover, the tenon may include configurations or structures such as, but not limited to, a tab, a peg, a key, a protrusion, and a leg. Still further, the mortise may include configurations or structures such as, but not limited to, a slot, a hole, an aperture, a groove, and a channel.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An interlocking structure for use by children comprising:

a floor panel comprising a floor tab, a floor groove, and a floor tenon, the floor tenon comprises a plurality of floor tenon edges defining a first triangular shaped aperture having one wide corner and two narrow corners;

at least one side panel removably coupled to the floor panel and comprising a first side tab, a second side tab, a first side groove, a second side groove, and a third side groove, the third side groove is removably coupled to the floor groove;

a top panel removably coupled to the side panel and comprising a top tab, a top groove, and a top tenon, the top tab is removably coupled to the second side groove and the top groove is removably coupled to the first side tab, the top tenon comprises a plurality of top tenon edges defining a second triangular shaped aperture having one wide corner and two narrow corners; the top panel being spaced from the floor panel when the structure is assembled; the top panel being non parallel to the floor panel when the structure is assembled such that the top tenon is non parallel to the floor tenon;

a back panel removably coupled to the side panel and the top panel and comprising a back tab, a back groove, a first back mortise and a second back mortise spaced from the first back mortise, the back tab is removably coupled to the first side groove, the first back mortise is configured to receive the floor tenon and the second back mortise is configured to receive the top tenon such that the top tenon is spaced from the floor tenon; and an elongate rod extendable through both the first triangular shaped aperture and the second triangular shaped aperture so as to extend between the top panel and the floor panel and to securely couple the floor panel to the top panel, the rod selectively moveable laterally within at least one of the first triangular shaped aperture or the second triangular shaped aperture toward at least one narrow corner of the one or more first narrow corners or the one or more second narrow corners for a pressure fit connection between the rod and at least one of the floor tenon or the top tenon.

2. The interlocking structure of claim 1 wherein the rod is extendable through one of the first triangular shaped aperture or the second triangular shaped aperture at a peak of the one of the first triangular shaped aperture or the second triangular shaped aperture.

3. The interlocking structure of claim 1 wherein the rod is removably coupled to the back panel.

4. The interlocking structure of claim 1 wherein each of the first triangular shaped aperture and the second triangular shaped aperture is configured to allow the rod to pressurably move within the triangular shaped apertures.

5. The interlocking structure of claim 1 wherein the floor tenon comprises a first floor tenon and a second floor tenon.

6. The interlocking structure of claim 1 wherein the top tenon comprises a first top tenon and a second top tenon.

7. The interlocking structure of claim 1 wherein the rod comprises a first rod and a second rod.

8. The interlocking structure of claim 1 further comprising an intermediate floor panel removably coupled to at least one of the side panel and the back panel and comprises an intermediate tenon.

9. The interlocking structure of claim 8 further comprising a loft panel removably coupled to the at least one of the side panel and the back panel and comprises a loft tenon.

10. The interlocking structure of claim 1 further comprising a first intermediate tenon and a second intermediate tenon coupled to the rod.

11. The interlocking structure according to claim 1 wherein the structure is a doll house for use by children.

12. The interlocking structure according to claim 1 wherein the structure is a bookcase for use by children.

* * * * *